US010151556B2

(12) United States Patent
Kjellberg

(10) Patent No.: US 10,151,556 B2
(45) Date of Patent: Dec. 11, 2018

(54) CONCEALABLE FIREARM

(71) Applicant: Ideal Conceal Inc., Monticello, MN (US)

(72) Inventor: Kirk Kjellberg, Monticello, MN (US)

(73) Assignee: Ideal Conceal Inc., Monticello, MN (US)

( * ) Notice: Subject to any disclaimer, the term of this patent is extended or adjusted under 35 U.S.C. 154(b) by 0 days.

(21) Appl. No.: 15/259,857

(22) Filed: Sep. 8, 2016

(65) Prior Publication Data

US 2017/0205186 A1 Jul. 20, 2017

Related U.S. Application Data

(60) Provisional application No. 62/215,419, filed on Sep. 8, 2015.

(51) Int. Cl.

| | |
|---|---|
| ***F41A 9/61*** | (2006.01) |
| ***F41C 9/02*** | (2006.01) |
| ***F41A 11/04*** | (2006.01) |

(52) U.S. Cl.

CPC ..... *F41C 9/02* (2013.01); *F41A 11/04* (2013.01)

(58) Field of Classification Search

USPC ..... 42/7, 1.09

See application file for complete search history.

(56) References Cited

U.S. PATENT DOCUMENTS

| | | | | |
|---|---|---|---|---|
| 2,699,008 | A | 1/1955 | Tyler | |
| 4,625,621 | A * | 12/1986 | Warin | F41A 11/04 42/1.09 |
| 6,234,058 | B1 | 5/2001 | Morgado | |
| 7,739,821 | B1 | 6/2010 | Hamme | |
| 7,941,954 | B2 * | 5/2011 | Carr | F41C 23/10 42/36 |
| 9,273,927 | B2 * | 3/2016 | Bondhus | F41C 3/00 |
| 2014/0027479 | A1 | 1/2014 | Hogue | |

FOREIGN PATENT DOCUMENTS

| | | |
|---|---|---|
| WO | WO 2007/039778 A2 | 4/2007 |
| WO | WO 2015/088794 A1 | 6/2015 |

OTHER PUBLICATIONS

PCT International Search Report and Written Opinion for International Application No. PCT/US2016/050716, dated Dec. 2, 2016.

* cited by examiner

*Primary Examiner* — J. Woodrow Eldred

(74) *Attorney, Agent, or Firm* — Winthrop & Weinstine, P.A.

(57) ABSTRACT

A concealable firearm is disclosed. The handle of the firearm is adjustable from a concealed position to an in-use position. When the handle is in the concealed position, the firearm has the appearance of a cell phone. This allows the firearm to be carried in the open and be easily accessible without drawing attention to the person carrying the firearm. The firearm cannot fire when in the concealed position because the trigger is not accessible.

21 Claims, 35 Drawing Sheets

SECTION A-A

SECTION AA-AA

SECTION A-A

CONCEALABLE FIREARM

CROSS-REFERENCE TO RELATED APPLICATION

The present application claims the benefit of U.S. Provisional Application No. 62/215,419 filed Sep. 8, 2015, entitled "CONCEALABLE FIREARM," which is hereby fully incorporated herein by reference.

FIELD OF THE INVENTION

The present invention relates to firearms and, more particularly, to a concealable handgun.

BACKGROUND OF THE INVENTION

Carrying a firearm in public has become more common as people become self-reliant for personal protection. All states in the United States now allow for the carrying of a handgun with varying degrees of permitting conditions. While some people openly carry handguns for protection, most prefer to conceal their firearm to not draw attention to themselves or make others uncomfortable.

Many find that carrying a concealed firearm is uncomfortable or inconvenient. Holsters can be worn on a shoulder or around an ankle, but are not comfortable, can be bulky, and can be seen through clothing. Handguns can be carried in a purse, backpack, or briefcase, but are not readily accessible when needed. One solution that has been around for decades is to design handguns that are small enough to carry in a pocket or small purse. However, such handguns tend to be low-caliber, are difficult to handle, and are prone to accidental discharge.

What is desired is a firearm that is does not appear to be a firearm when openly exposed and readily accessible to the person carrying it.

SUMMARY OF THE INVENTION

The present invention is directed to a firearm that can be carried openly, yet does not appear to be a firearm. The preferred embodiment is a handgun that adjusts between stored configuration and an in-use configuration. This embodiment has the appearance of a cell phone when in the stored configuration so that it is not apparent to others that the device is actually a handgun. Release of a grip latch allows the handle to rotate to an in-use position, exposing the trigger.

The above summary is not intended to describe each illustrated embodiment or every implementation of the subject matter hereof. Rather, the embodiments are chosen and described so that others skilled in the art can appreciate and understand the principles and practices of the invention. The figures and the detailed description that follow more particularly exemplify various embodiments.

ADVANTAGES OF THE INVENTION

Can be carried completely exposed without others identifying it as a firearm.

Easily converts from a stored configuration to an in-use configuration.

Small enough to fit into pants or jacket pocket or be clipped onto belt.

Cannot be fired in the stored configuration because trigger is not accessible.

BRIEF DESCRIPTION OF THE DRAWINGS

Subject matter hereof may be more completely understood in consideration of the following detailed description of various embodiments in connection with the accompanying figures, in which.

Figure 1:
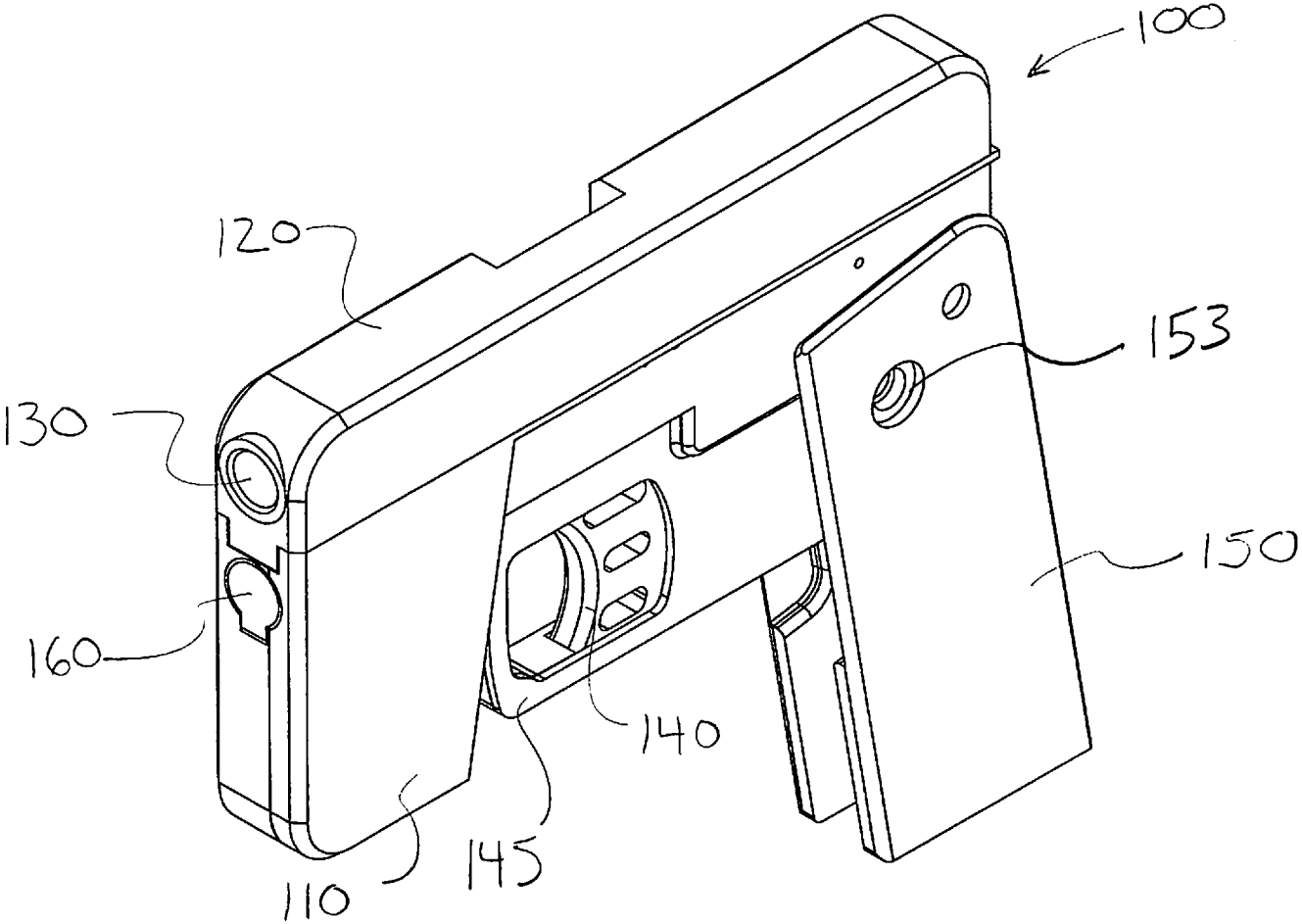
FIG. 1 is a front right perspective of a concealable firearm according to an embodiment of the invention in its in-use configuration.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

A concealable firearm according to an embodiment of the invention is depicted generally in FIG. 1 with reference numeral 100 in its in-use configuration. The concealable firearm 100 includes a receiver body 110, slide 120, barrel 130, trigger 140, and grip 150 that are typical of handguns known in the art. The concealable firearm 100 further includes a trigger guard 145 and a tubular magazine 160 for storage and longitudinal loading of bullets. In this configuration, the trigger 140 is accessible so that concealable firearm 100 may be fired, if loaded with bullets.

Figure 2:
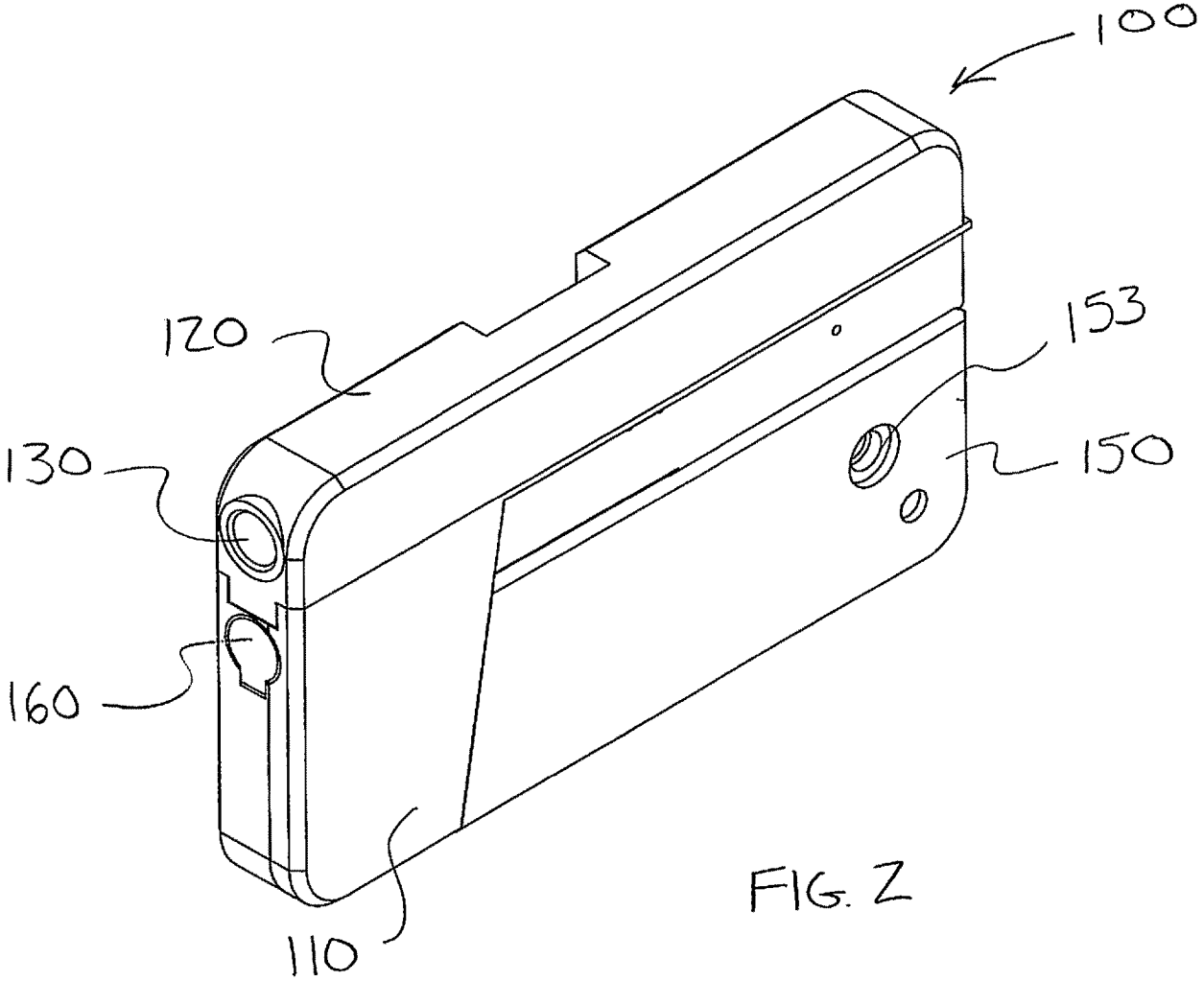
FIG. 2 is a front right perspective of a concealable firearm according to an embodiment of the invention in its stored configuration.
Figure 3:
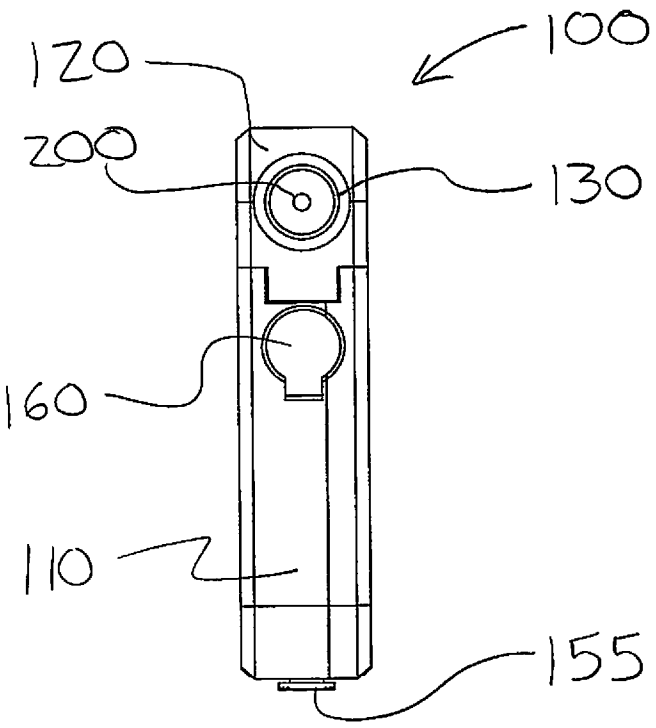
FIG. 3 is a front elevation view of a concealable firearm according to an embodiment of the invention in its stored configuration.
Figure 4:
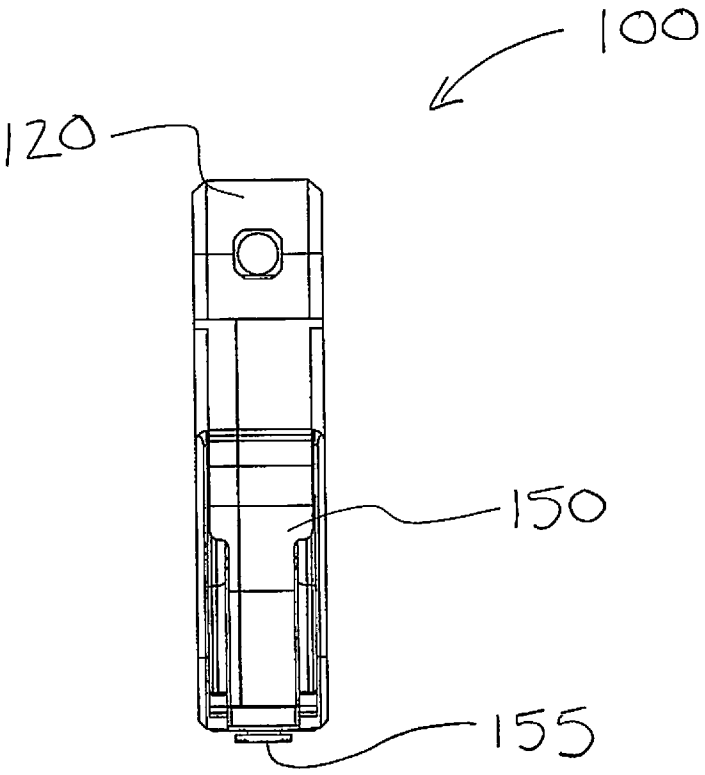
FIG. 4 is a rear elevation view of a concealable firearm according to an embodiment of the invention in its stored configuration.
Figure 5:
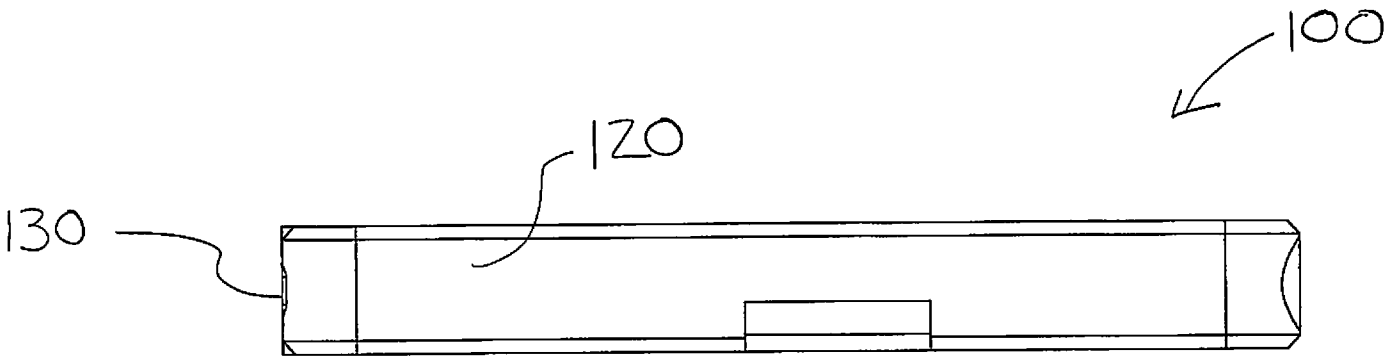
FIG. 5 is a top view of a concealable firearm according to an embodiment of the invention in its stored configuration.
Figure 6:
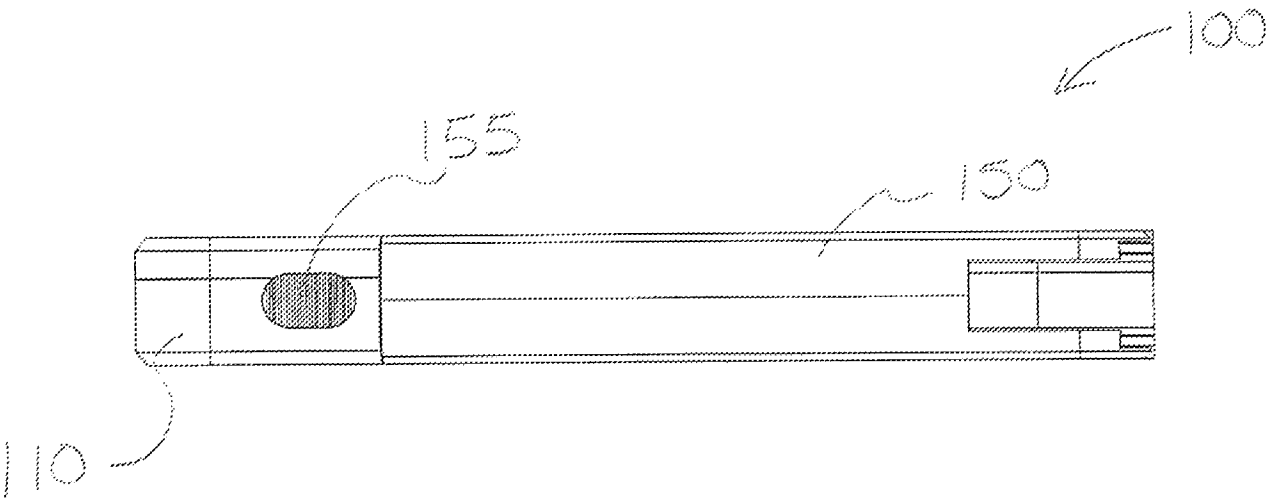
FIG. 6 is a bottom view of a concealable firearm according to an embodiment of the invention in its stored configuration.
Figure 7:
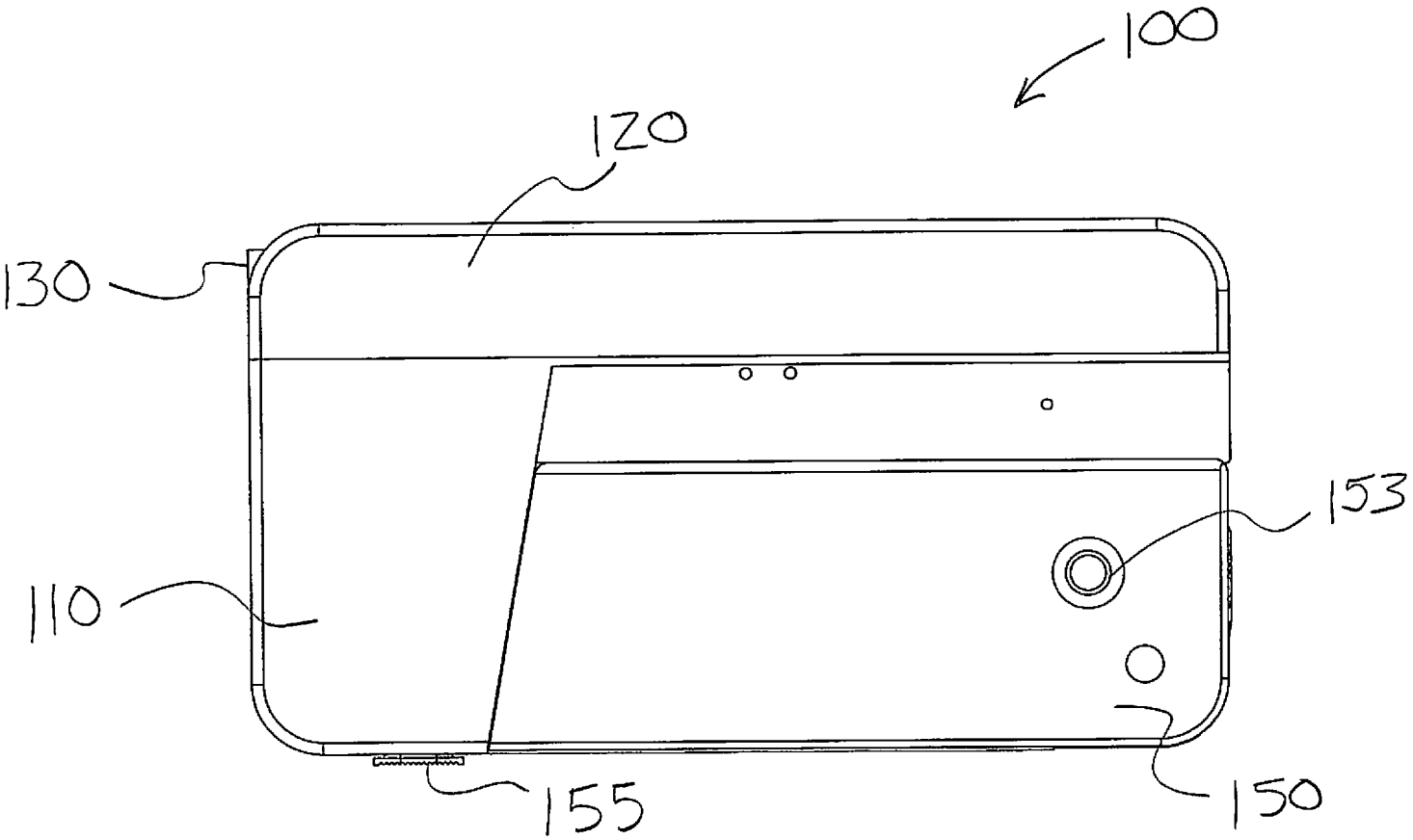
FIG. 7 is a right side elevation view of a concealable firearm according to an embodiment of the invention in its stored configuration.
Figure 8:
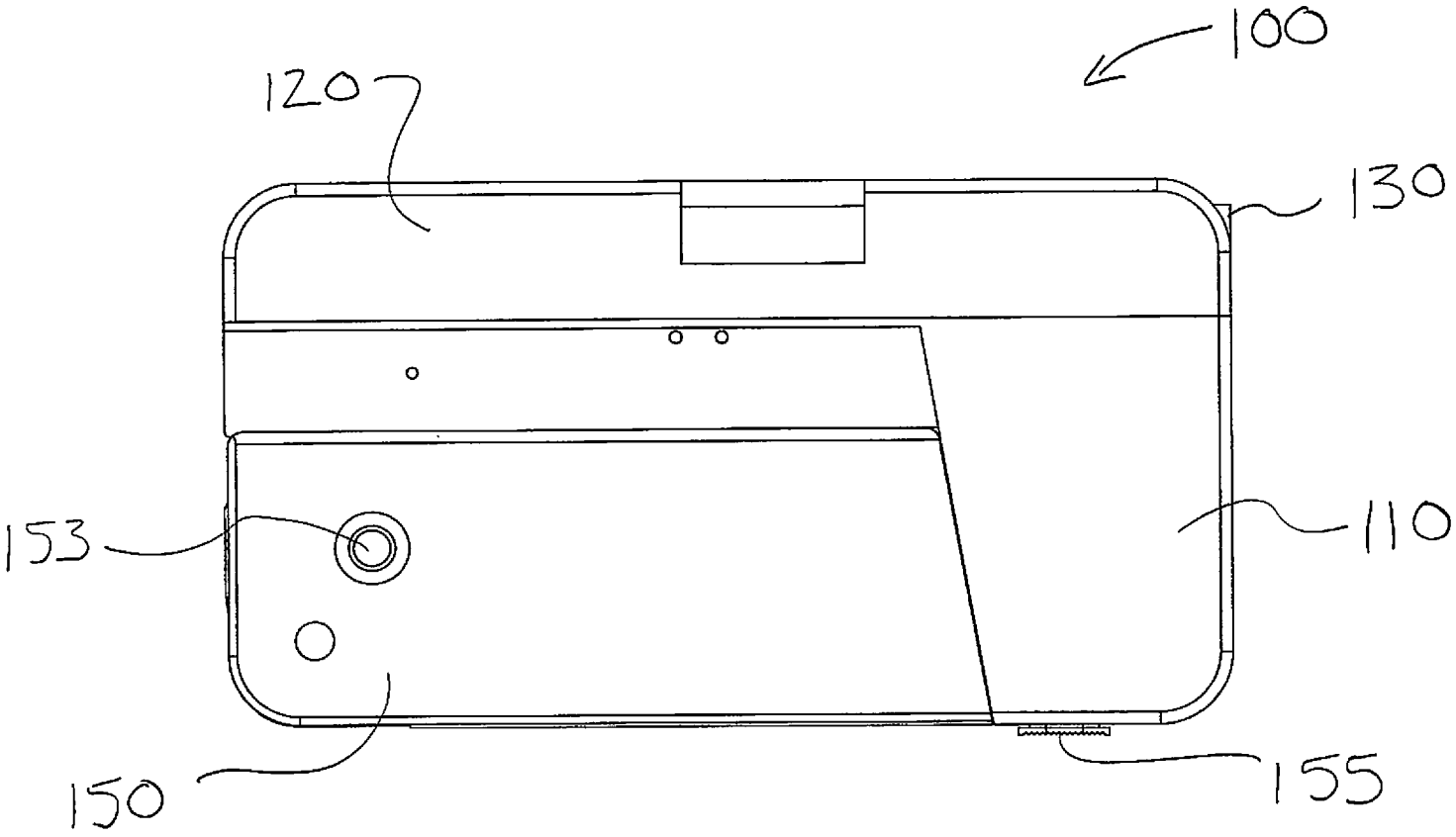
FIG. 8 is a left side elevation view of a concealable firearm according to an embodiment of the invention in its stored configuration.

FIG. 2 presents the same embodiment of the concealable firearm 100 in its stored configuration. When in this configuration, grip 150 is rotated to cover the trigger 140, making it inaccessible and, therefore, concealable firearm may 100 may not be fired. In the stored configuration, concealable firearm 100 has the shape, size, and appearance of a common smart phone. The concealable firearm 100 may have the appearance of any make of smart phone (e.g., Apple iPhone, Samsung Galaxy, etc.) or smart phone in a protective case (e.g., Otterbox, Case-Mate, etc.).

FIGS. 2-8 present views of the concealable firearm 100 in its stored configuration and illustrate its smart phone appearance in this configuration. The receiver body 110, slide 120, and grip 150 are all formed to give a combined facade of a cell phone. As can be seen in FIGS. 3-4 and 6-8, concealable firearm also includes a grip latch 155 to lock concealable firearm 100 in the stored position. In the preferred embodiment, grip latch 155 slides between its locked (back) and unlocked (forward) positions. Other types of grip latch 155 (push button, rotating, etc.) are also contemplated.

FIGS. 9-14 present the same embodiment of the concealed firearm 100 shown in FIGS. 1-8, but in the in-use configuration. As can best be seen in FIGS. 13-14, the grip 150 is rotated down to expose the trigger 140. The grip 150 rotates about a grip pivot 153 that is configured to look like the camera lens of a cell phone. The preferred embodiment includes a trigger guard 145 to prevent accidental firing, damage to the trigger 140, and provide structural stability to the concealed firearm 100. However, trigger guard 145 is not necessary and may be eliminated for weight considerations.

Figure 9:
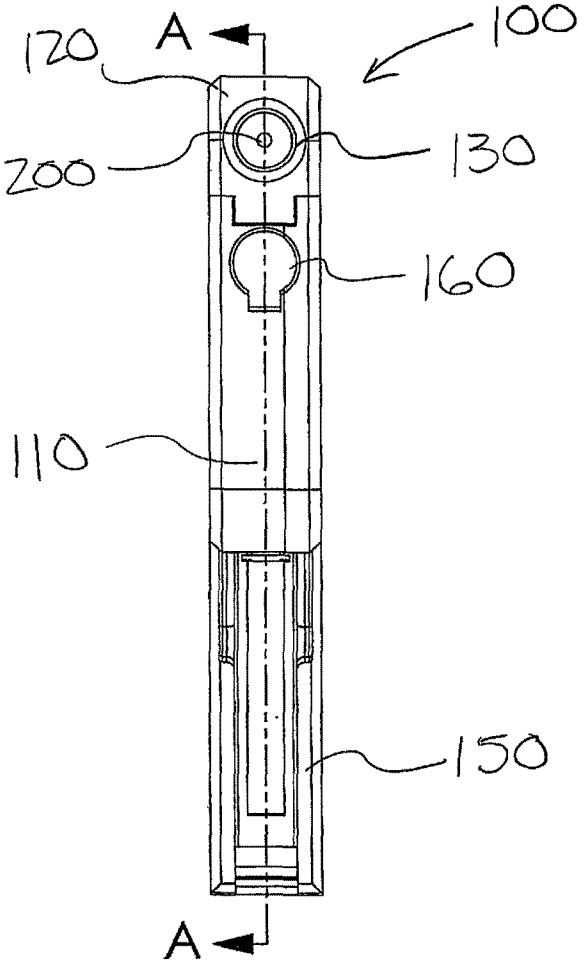
FIG. 9 is a front elevation view of a concealable firearm according to an embodiment of the invention in its in-use configuration.
Figure 10:
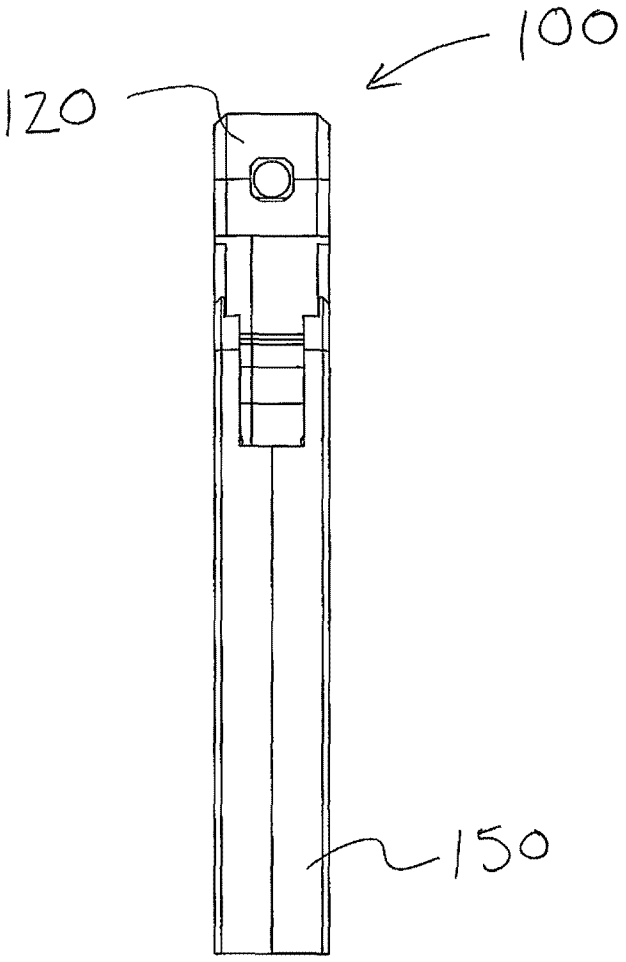
FIG. 10 is a rear elevation view of a concealable firearm according to an embodiment of the invention in its in-use configuration.
Figure 11:
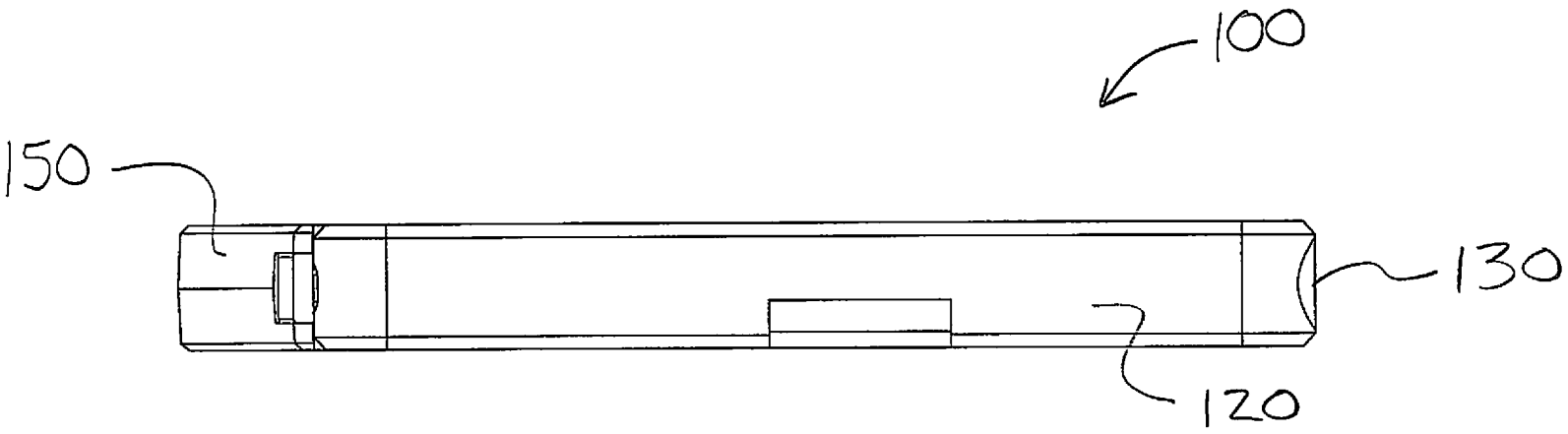
FIG. 11 is a top view of a concealable firearm according to an embodiment of the invention in its in-use configuration.
Figure 12:
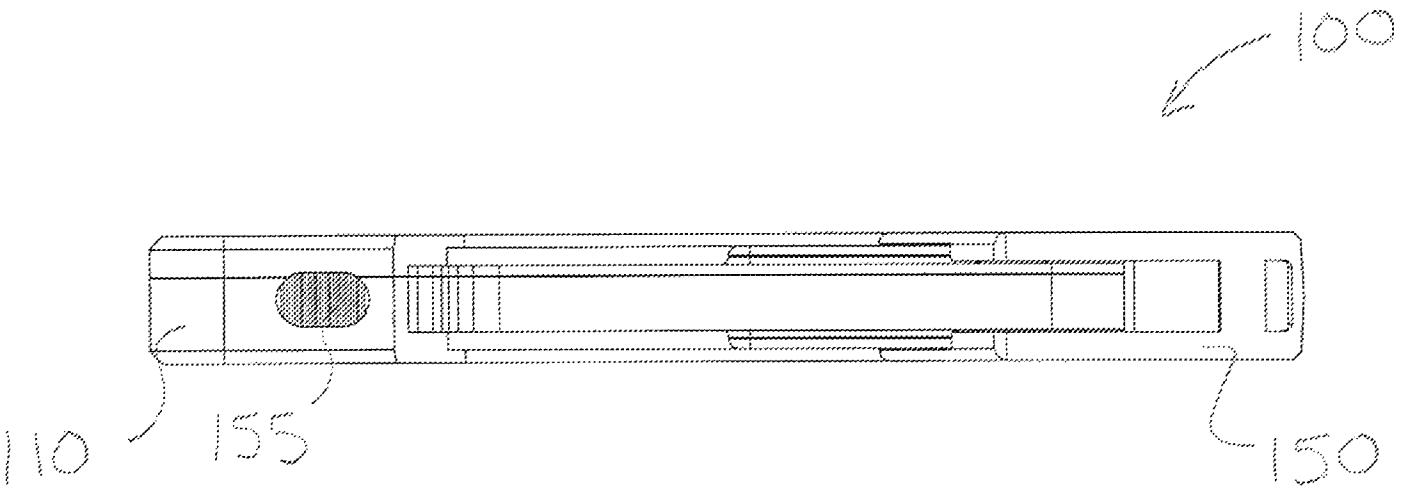
FIG. 12 is a bottom view of a concealable firearm according to an embodiment of the invention in its in-use configuration
Figure 13:
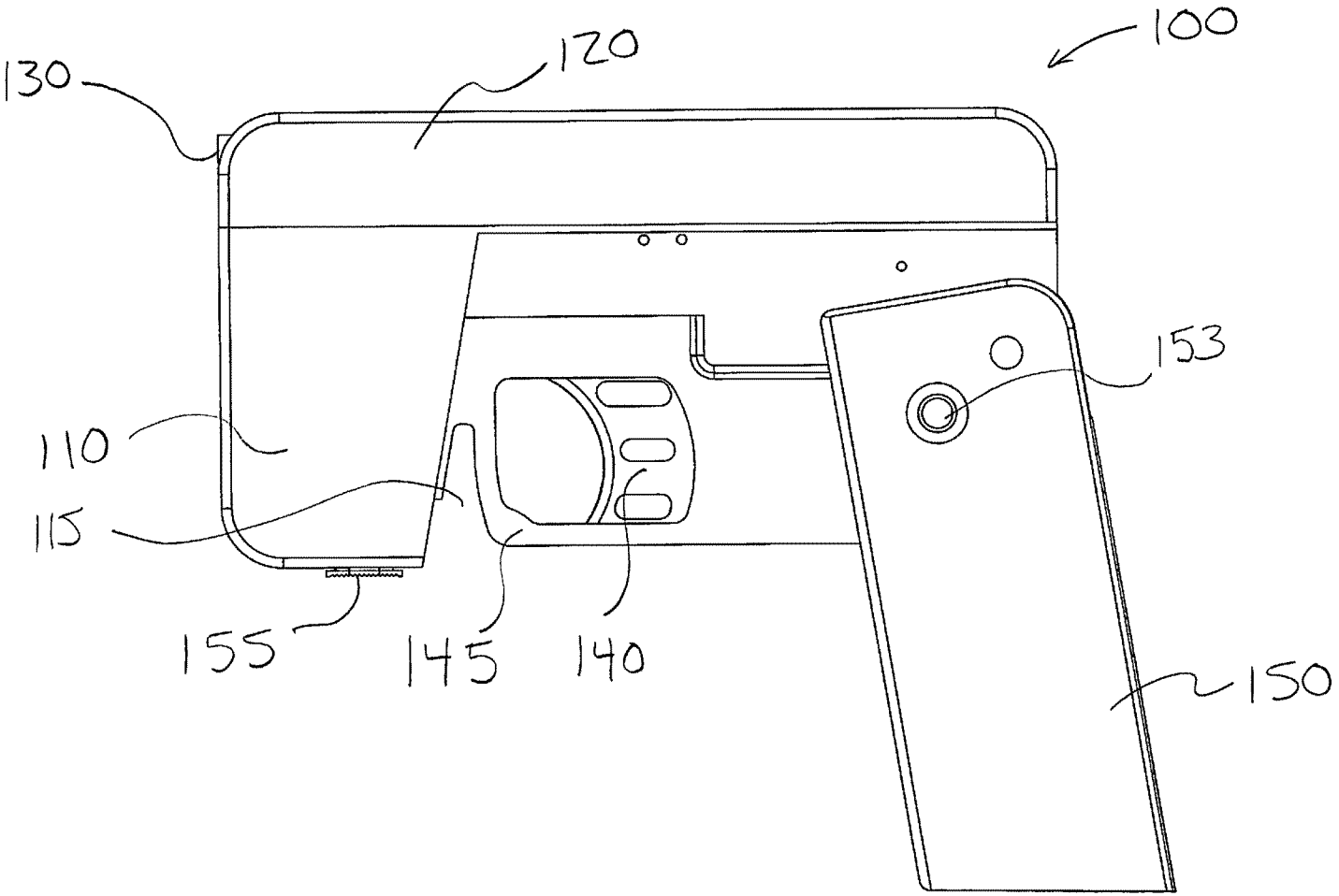
FIG. 13 is a right side elevation view of a concealable firearm according to an embodiment of the invention in its in-use configuration.
Figure 14:
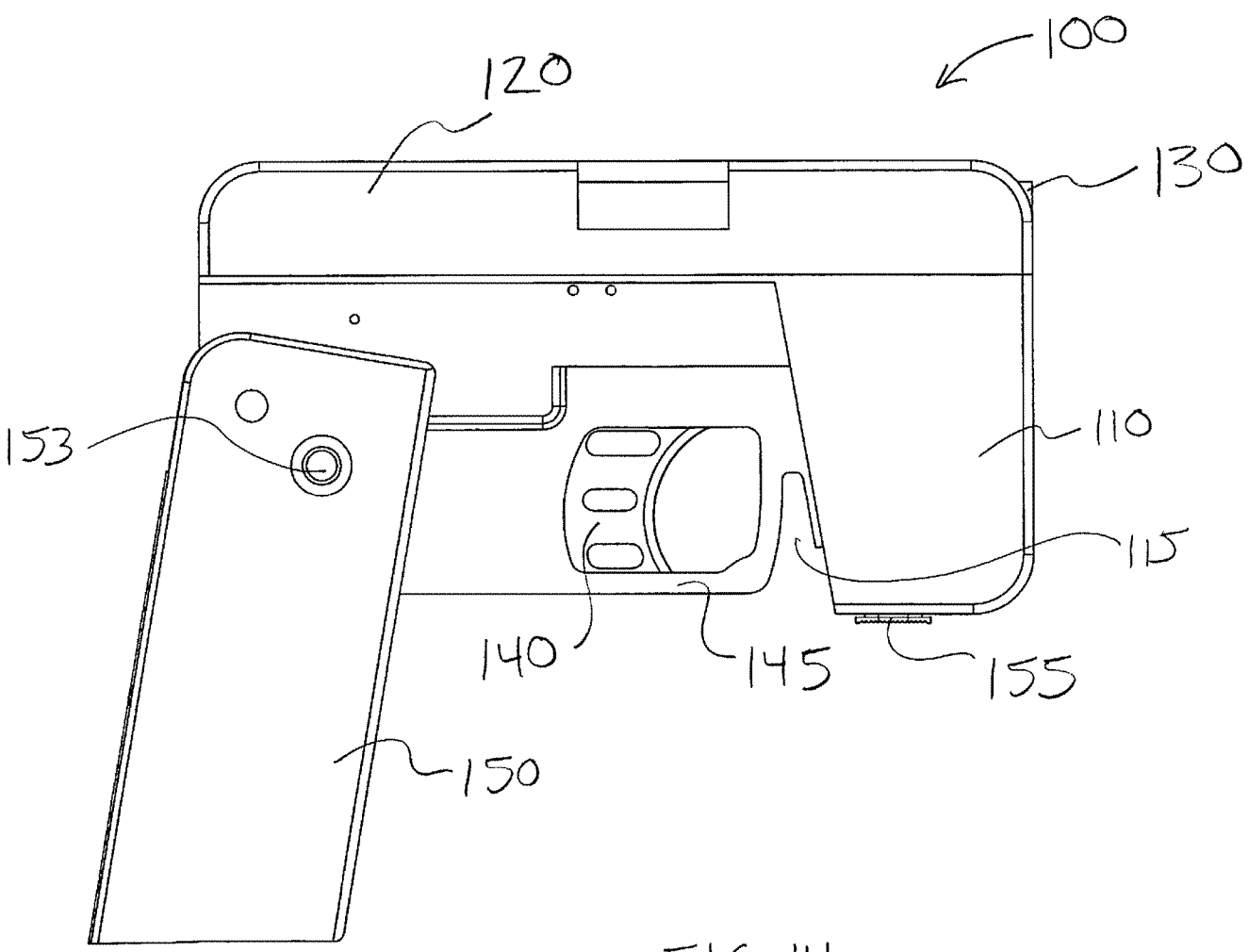
FIG. 14 is a left side elevation view of a concealable firearm according to an embodiment of the invention in its in-use configuration.
Figure 15:
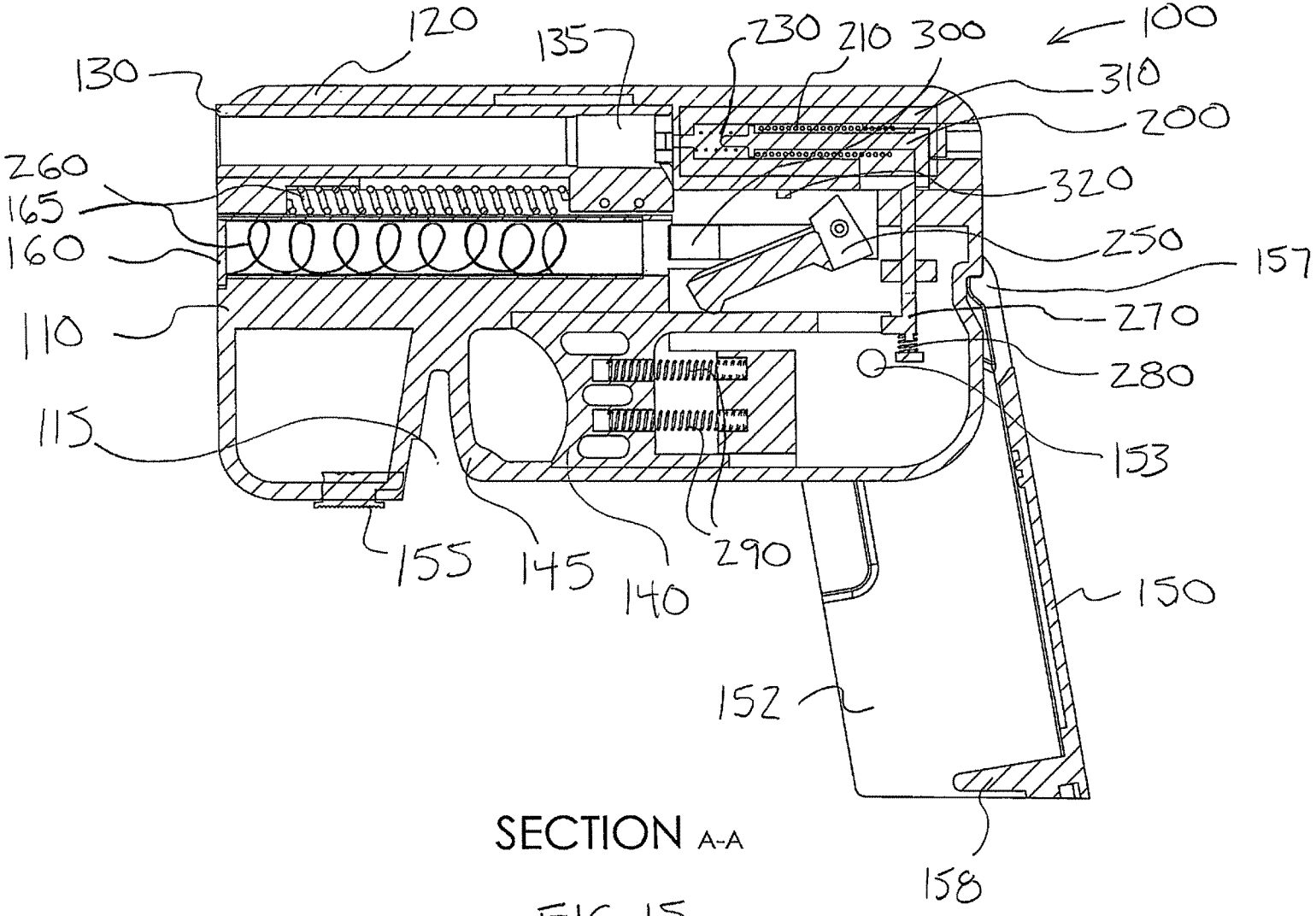
FIG. 15 is a sectional view of a concealable firearm according to an embodiment of the invention in its in-use configuration.
Figure 16:
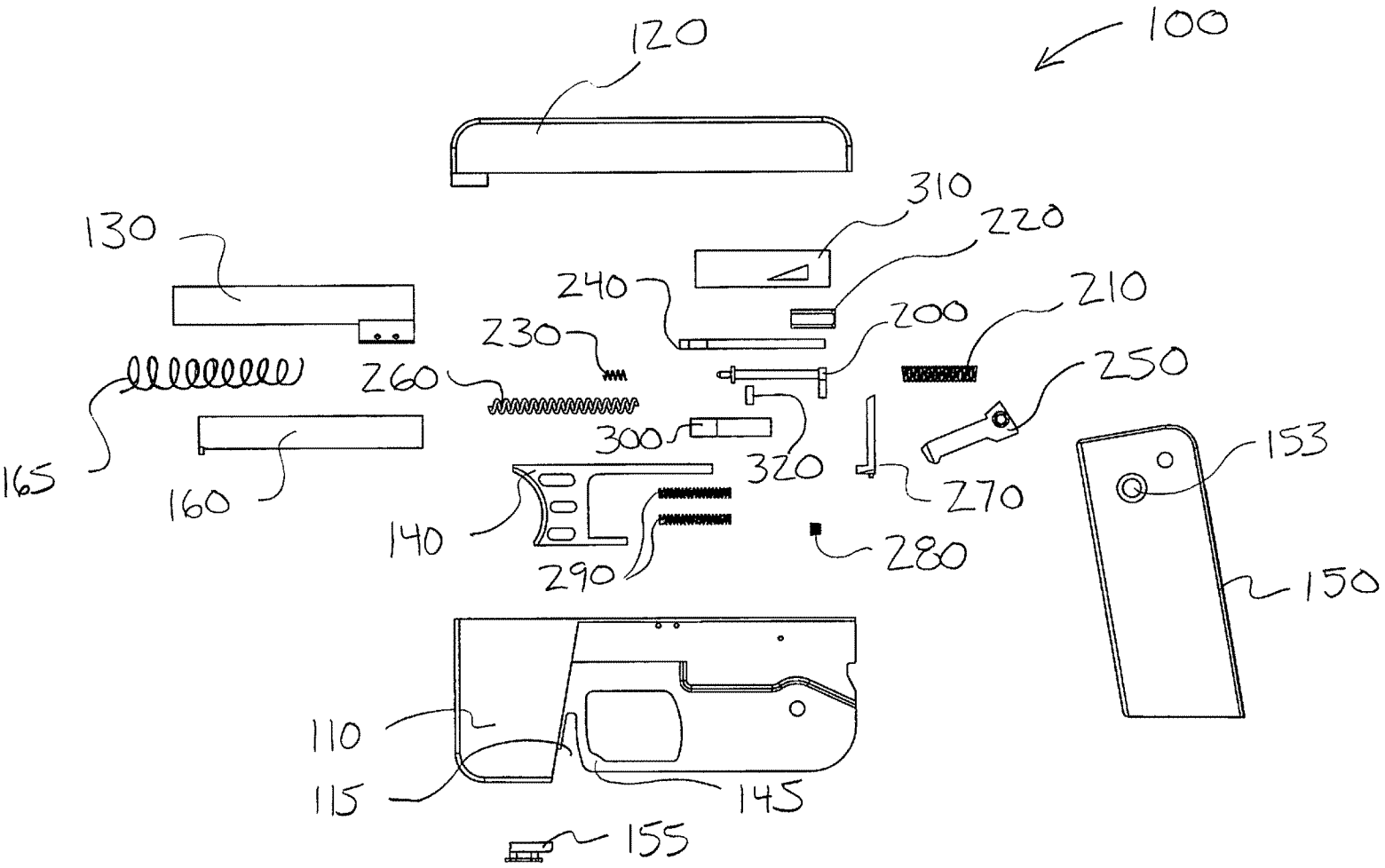
FIG. 16 is an exploded view of a concealable firearm according to an embodiment of the invention.
Figure 17:
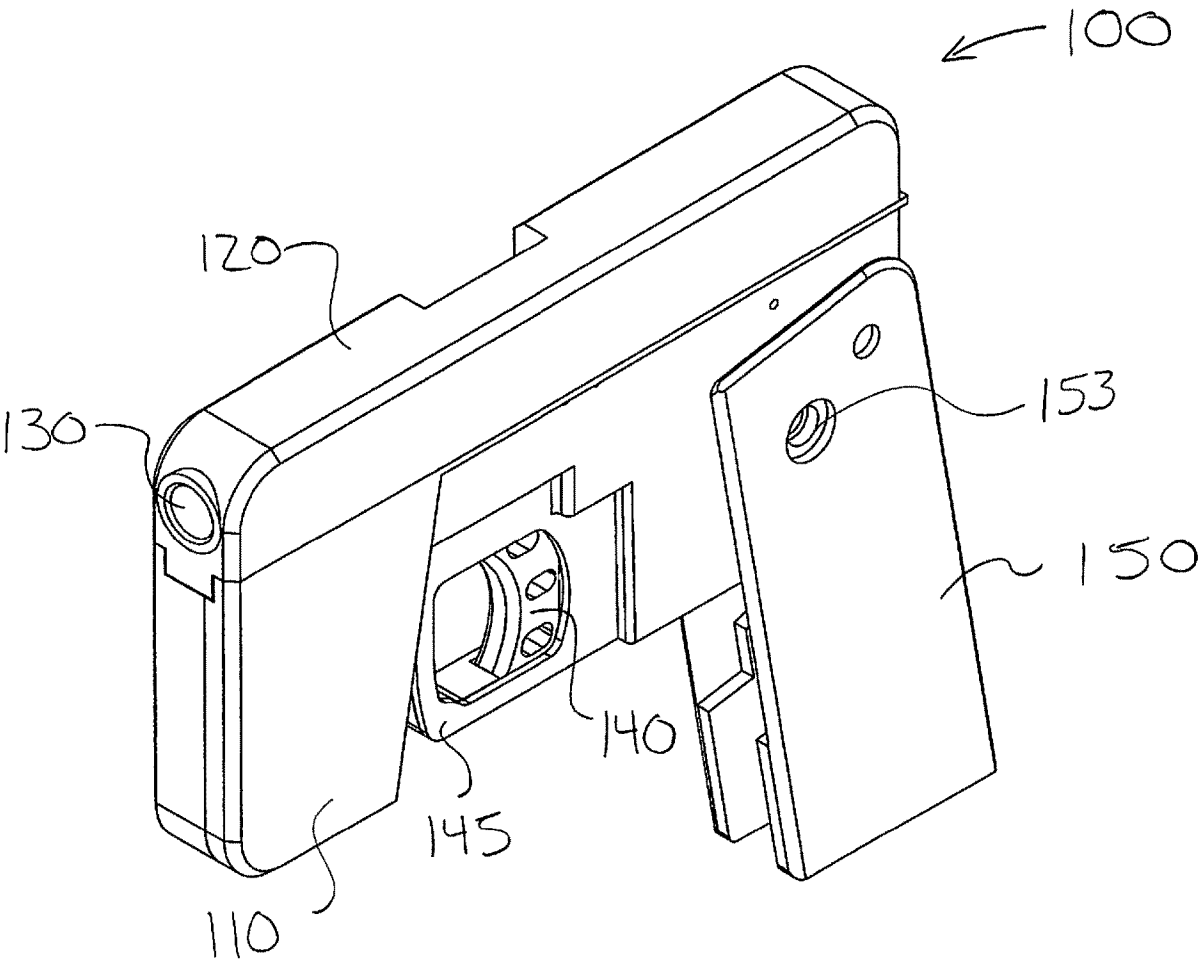
FIG. 17 is a front right perspective of a concealable firearm according to an alternate embodiment of the invention in its in-use configuration.
Figure 18:
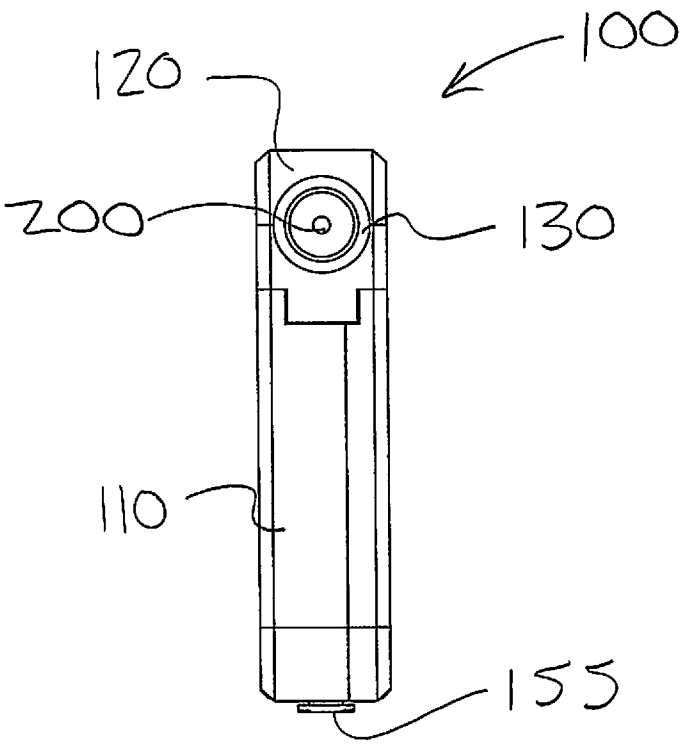
FIG. 18 is a front elevation view of a concealable firearm according to an alternate embodiment of the invention in its stored configuration.
Figure 19:
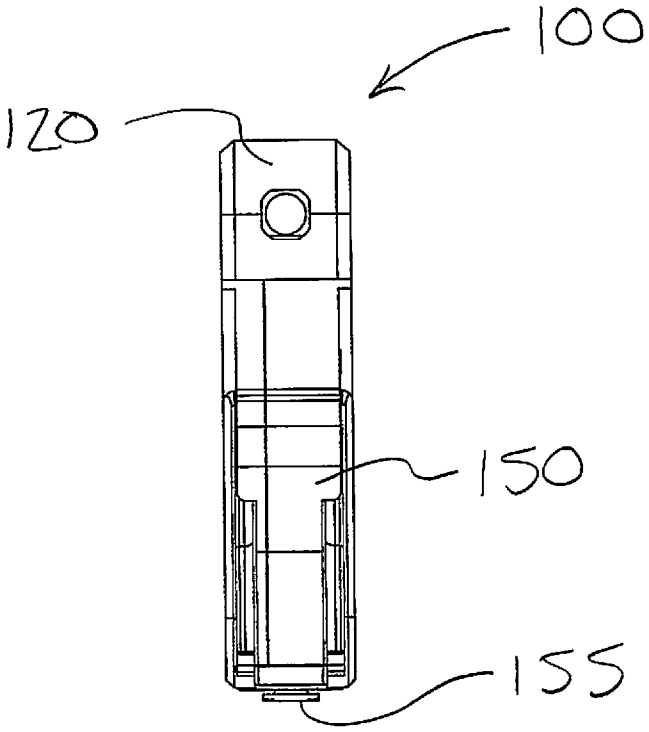
FIG. 19 is a rear elevation view of a concealable firearm according to an alternate embodiment of the invention in its stored configuration.
Figure 20:
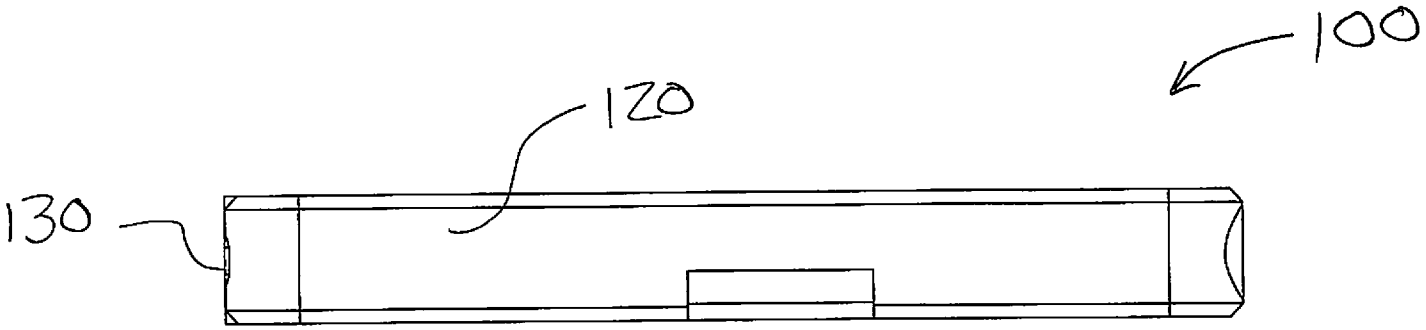
FIG. 20 is a top view of a concealable firearm according to an alternate embodiment of the invention in its stored configuration.
Figure 21:
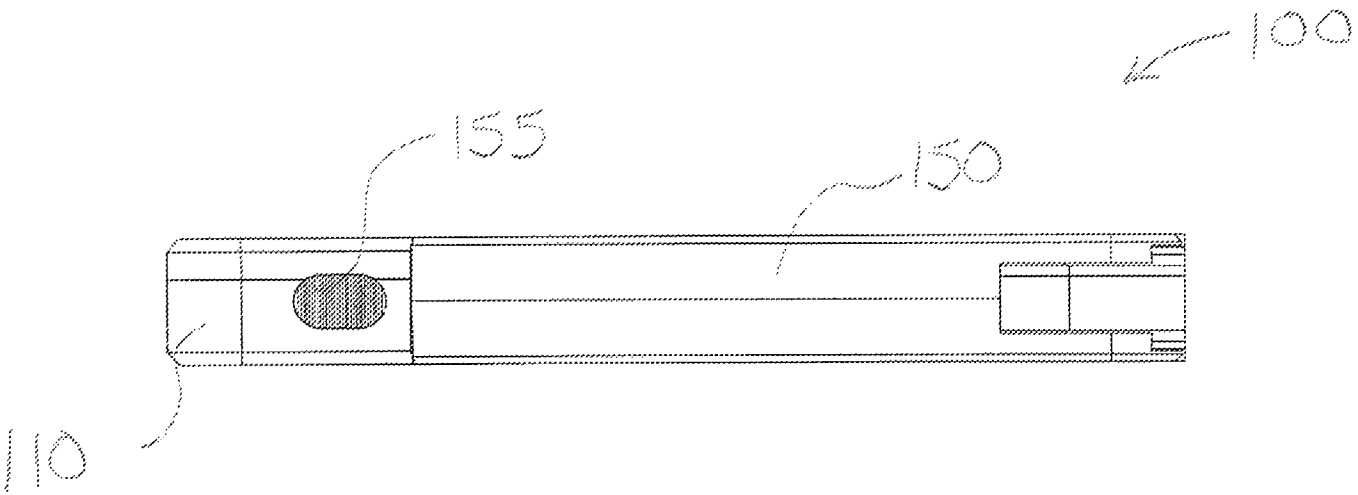
FIG. 21 is a bottom view of a concealable firearm according to an alternate embodiment of the invention in its stored configuration.
Figure 22:
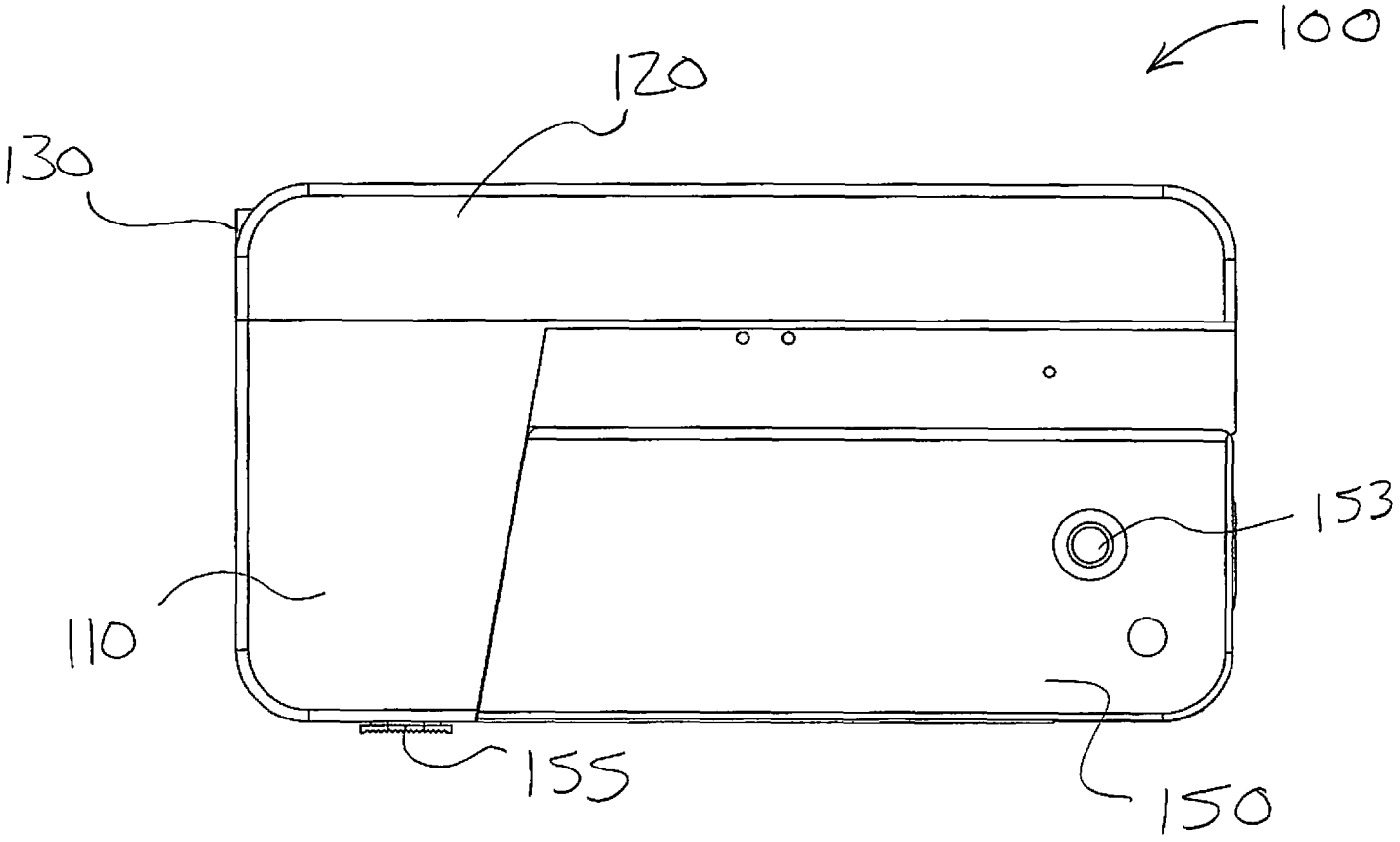
FIG. 22 is a right side elevation view of a concealable firearm according to an alternate embodiment of the invention in its stored configuration.
Figure 23:
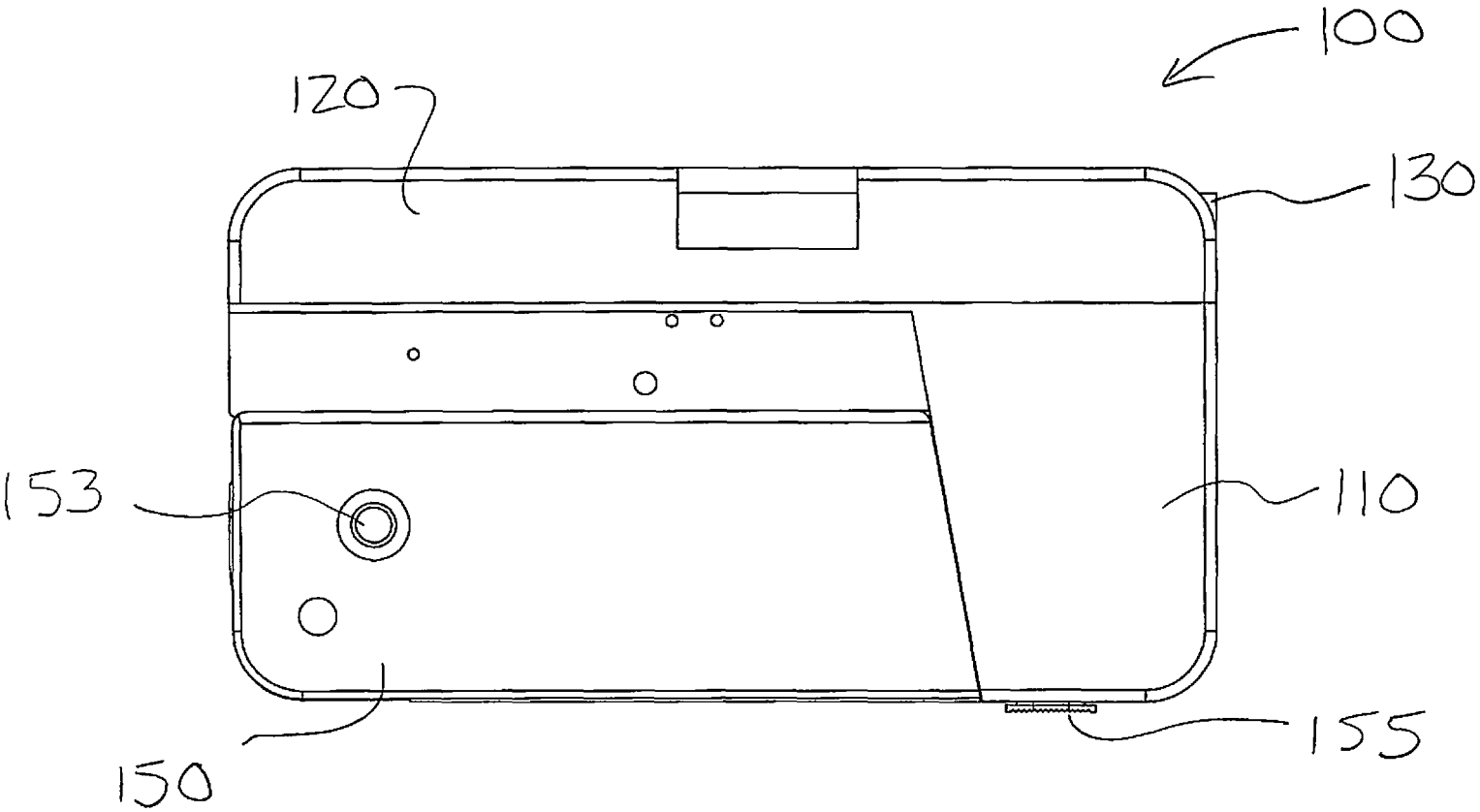
FIG. 23 is a left side elevation view of a concealable firearm according to an alternate embodiment of the invention in its stored configuration.
Figure 24:
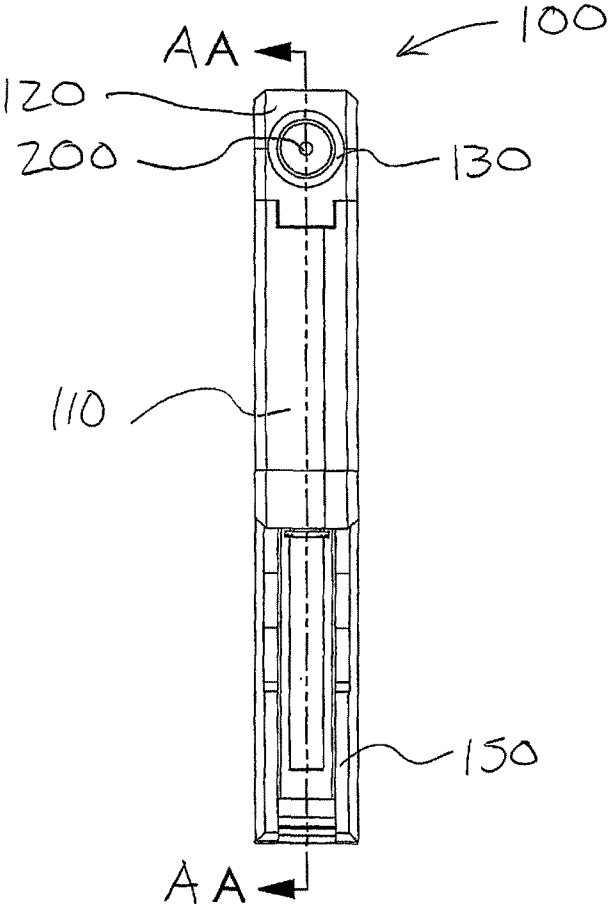
FIG. 24 is a front elevation view of a concealable firearm according to an alternate embodiment of the invention in its in-use configuration.
Figure 25:
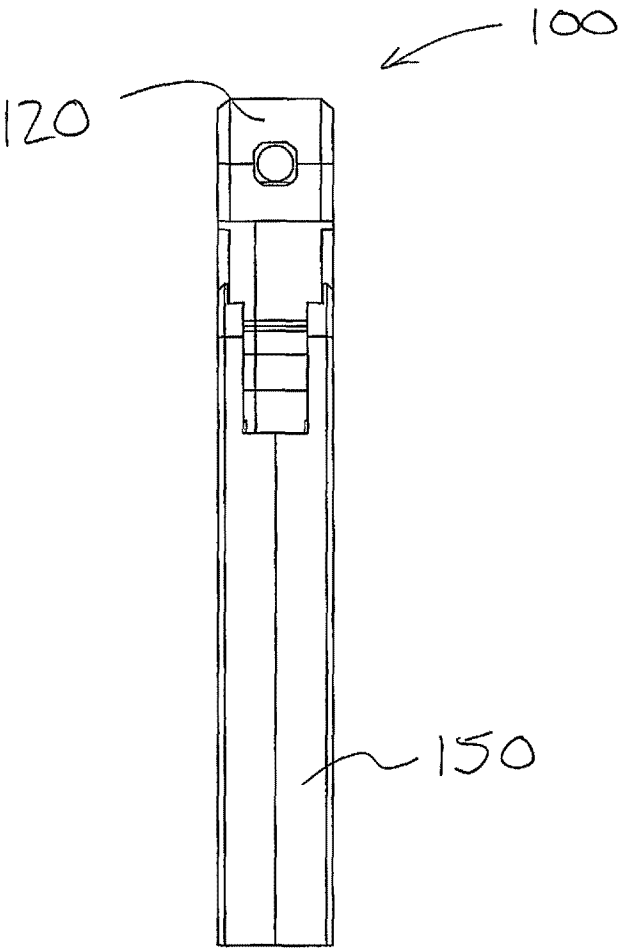
FIG. 25 is a rear elevation view of a concealable firearm according to an alternate embodiment of the invention in its in-use configuration.
Figure 26:
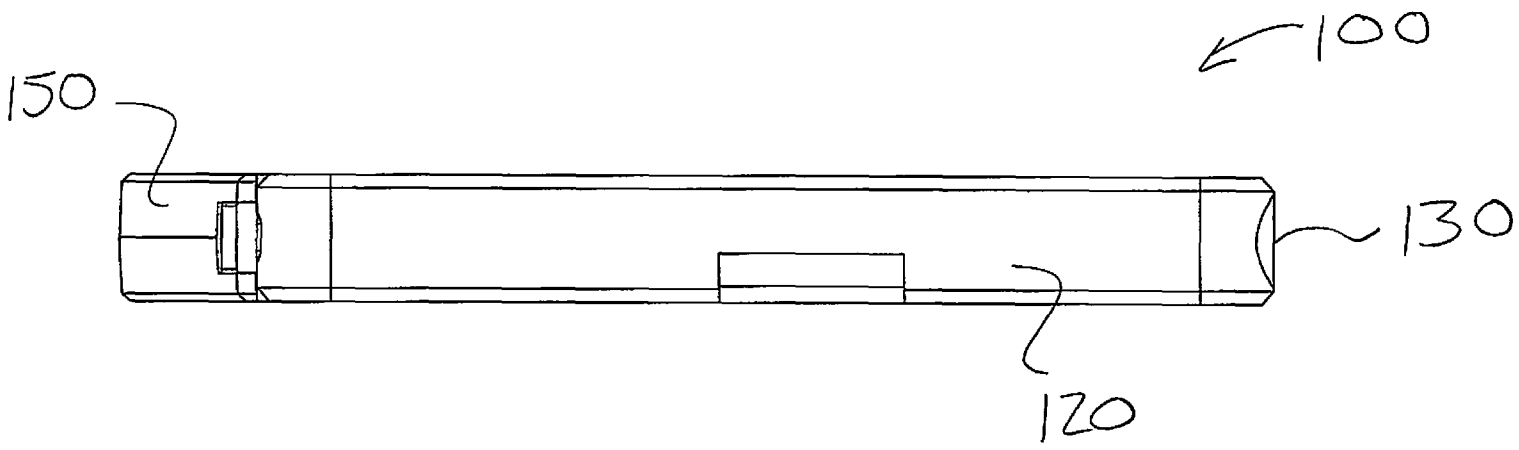
FIG. 26 is a top view of a concealable firearm according to an alternate embodiment of the invention in its in-use configuration.
Figure 27:
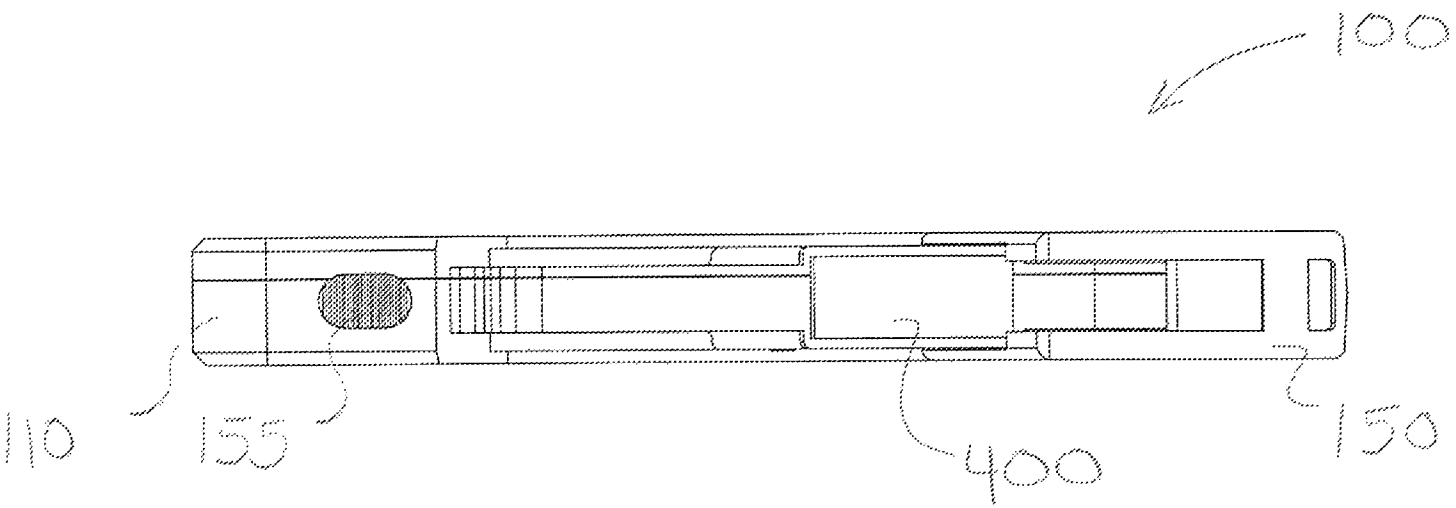
FIG. 27 is a bottom view of a concealable firearm according to an alternate embodiment of the invention in its in-use configuration
Figure 28:
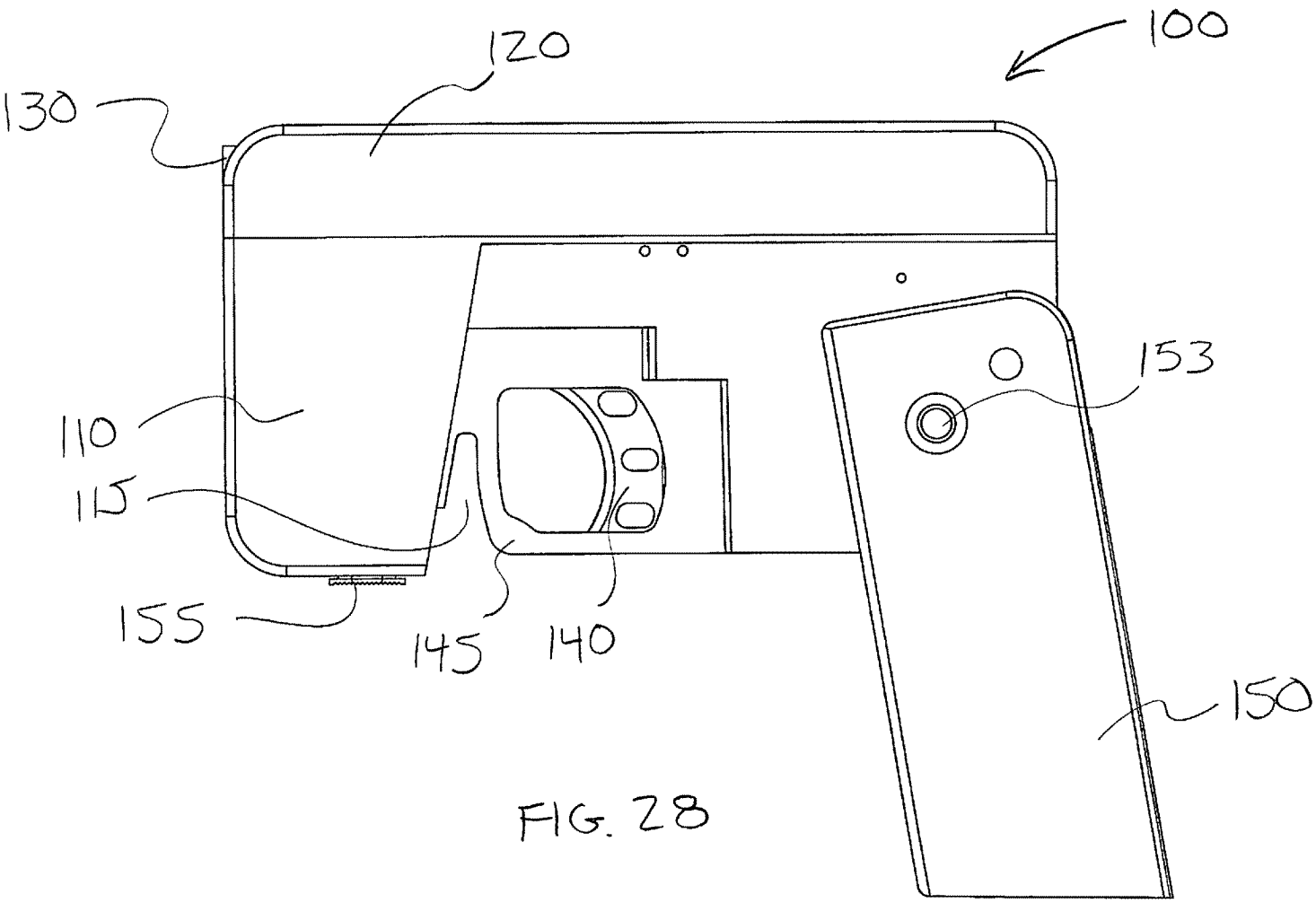
FIG. 28 is a right side elevation view of a concealable firearm according to an alternate embodiment of the invention in its in-use configuration.
Figure 29:
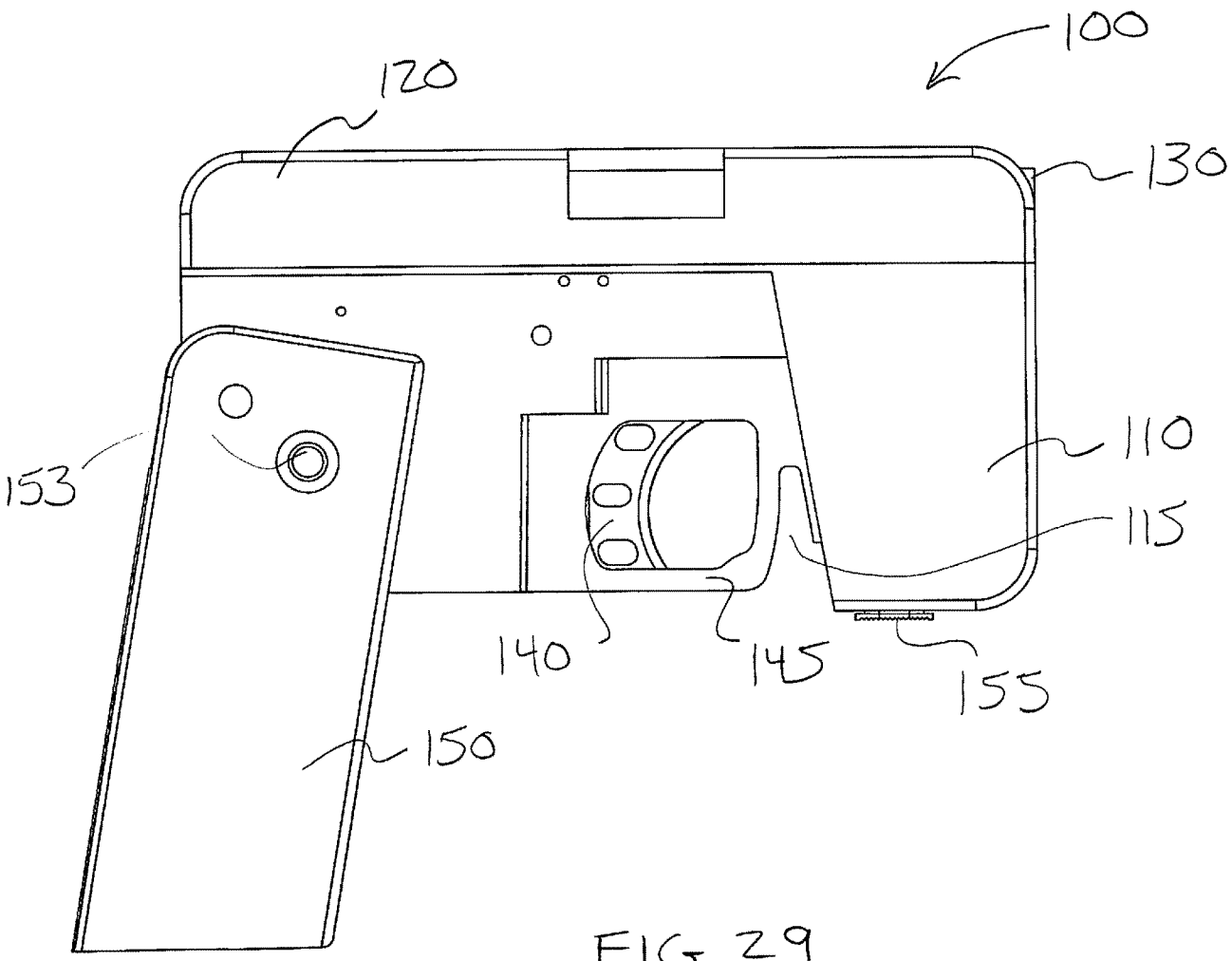
FIG. 29 is a left side elevation view of a concealable firearm according to an alternate embodiment of the invention in its in-use configuration.
Figure 30:
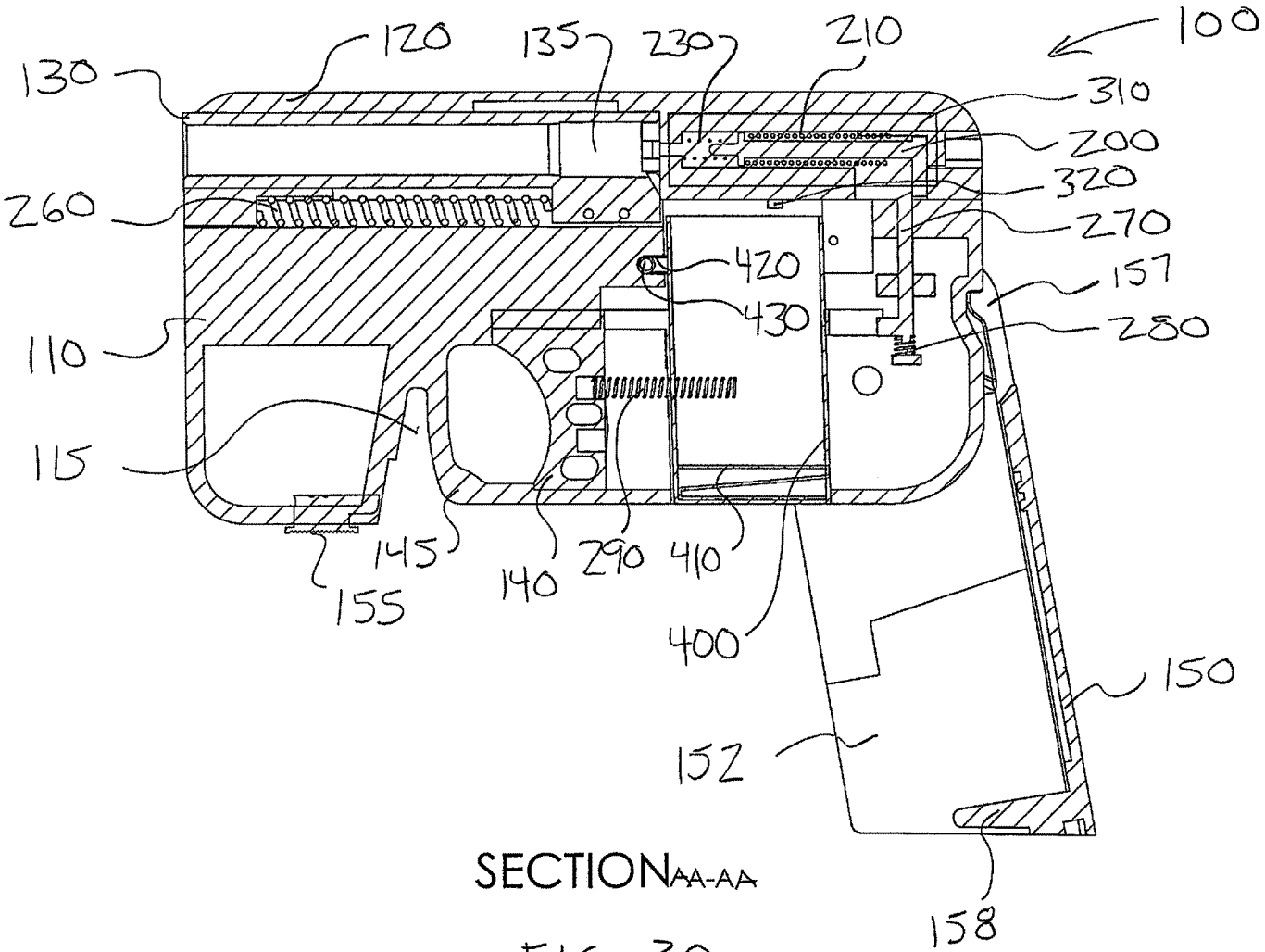
FIG. 30 is a sectional view of a concealable firearm according to an alternate embodiment of the invention in its in-use configuration.
Figure 31:
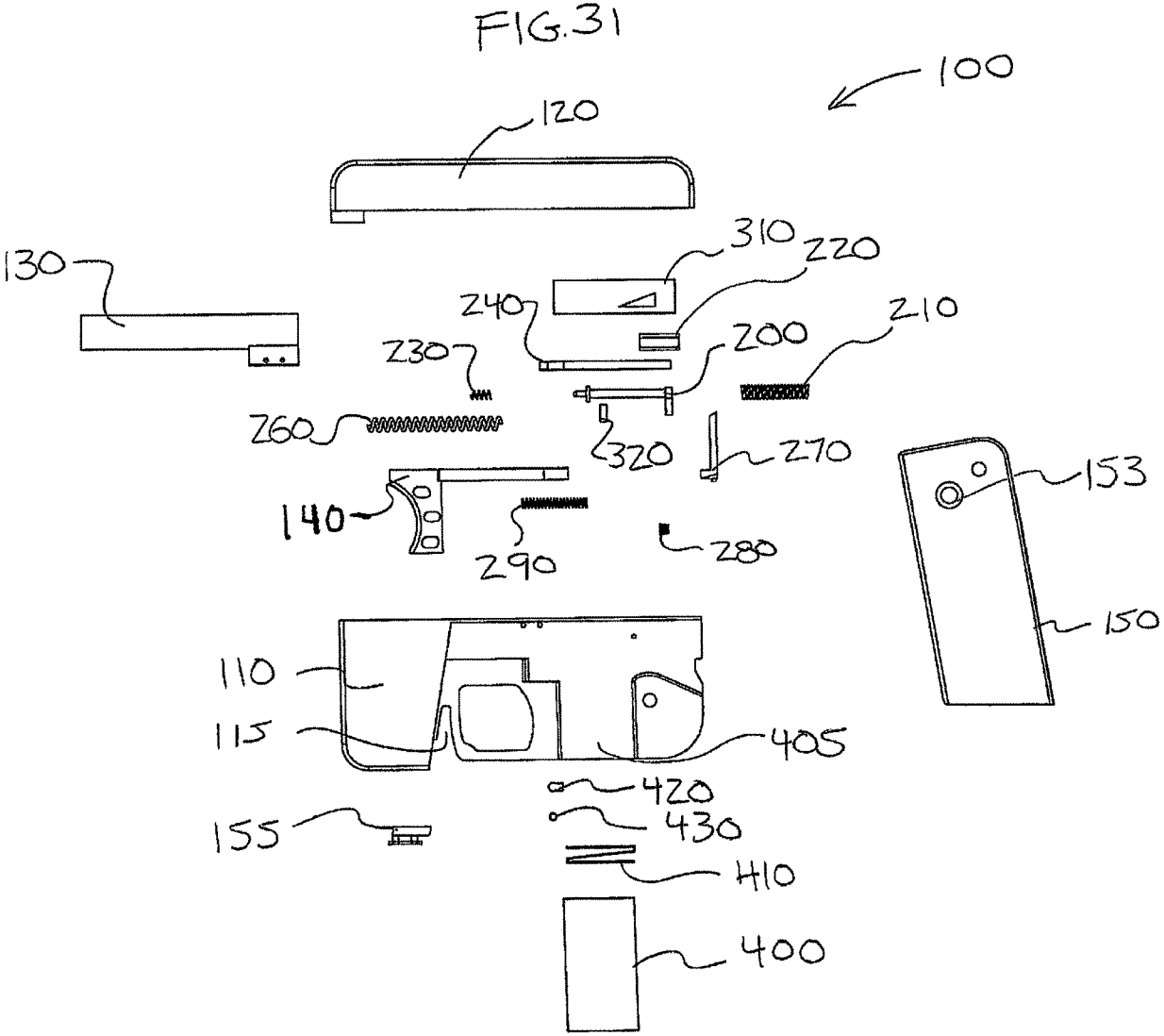
FIG. 31 is an exploded view of a concealable firearm according to an alternate embodiment of the invention.
Figure 32:
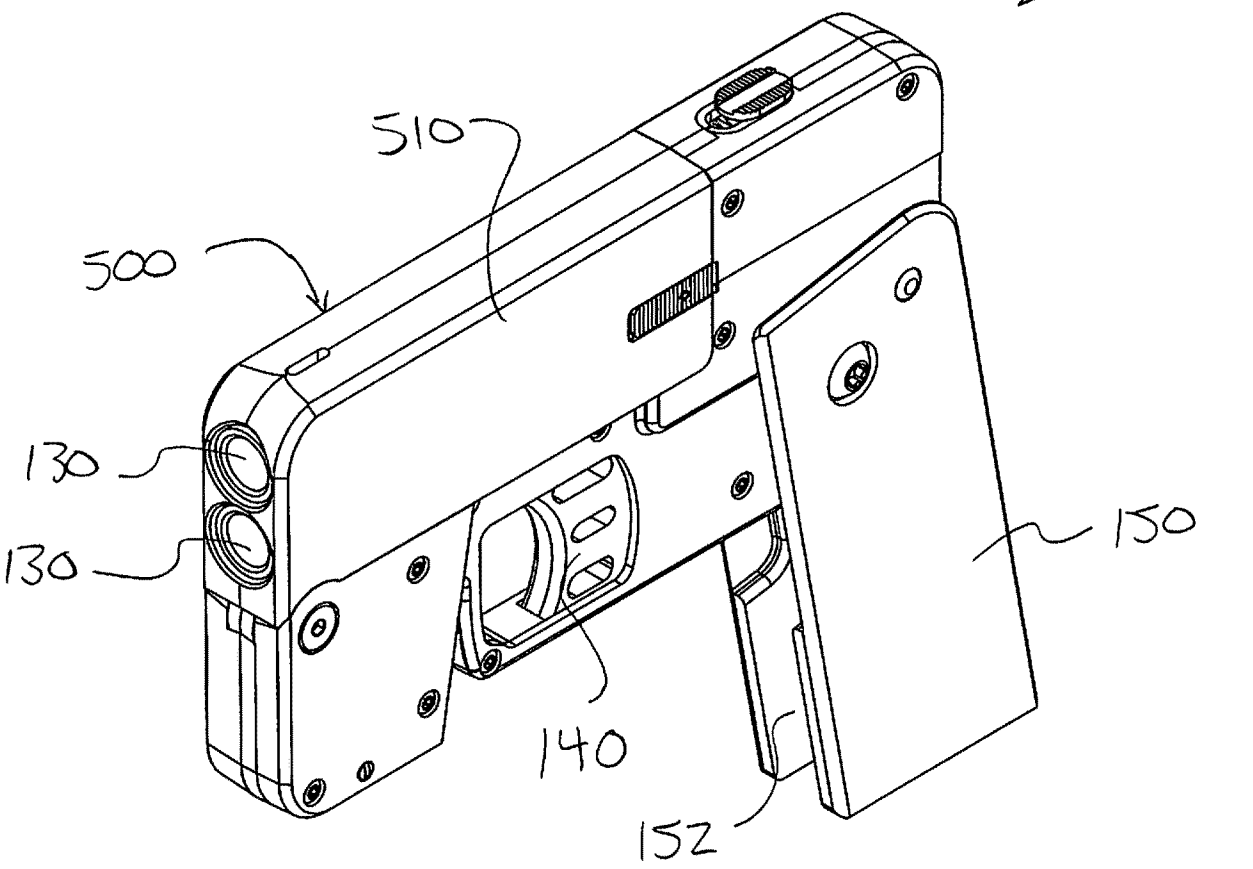
FIG. 32 is a front right perspective of a concealable firearm according to a third embodiment of the invention in its in-use configuration.
Figure 33:
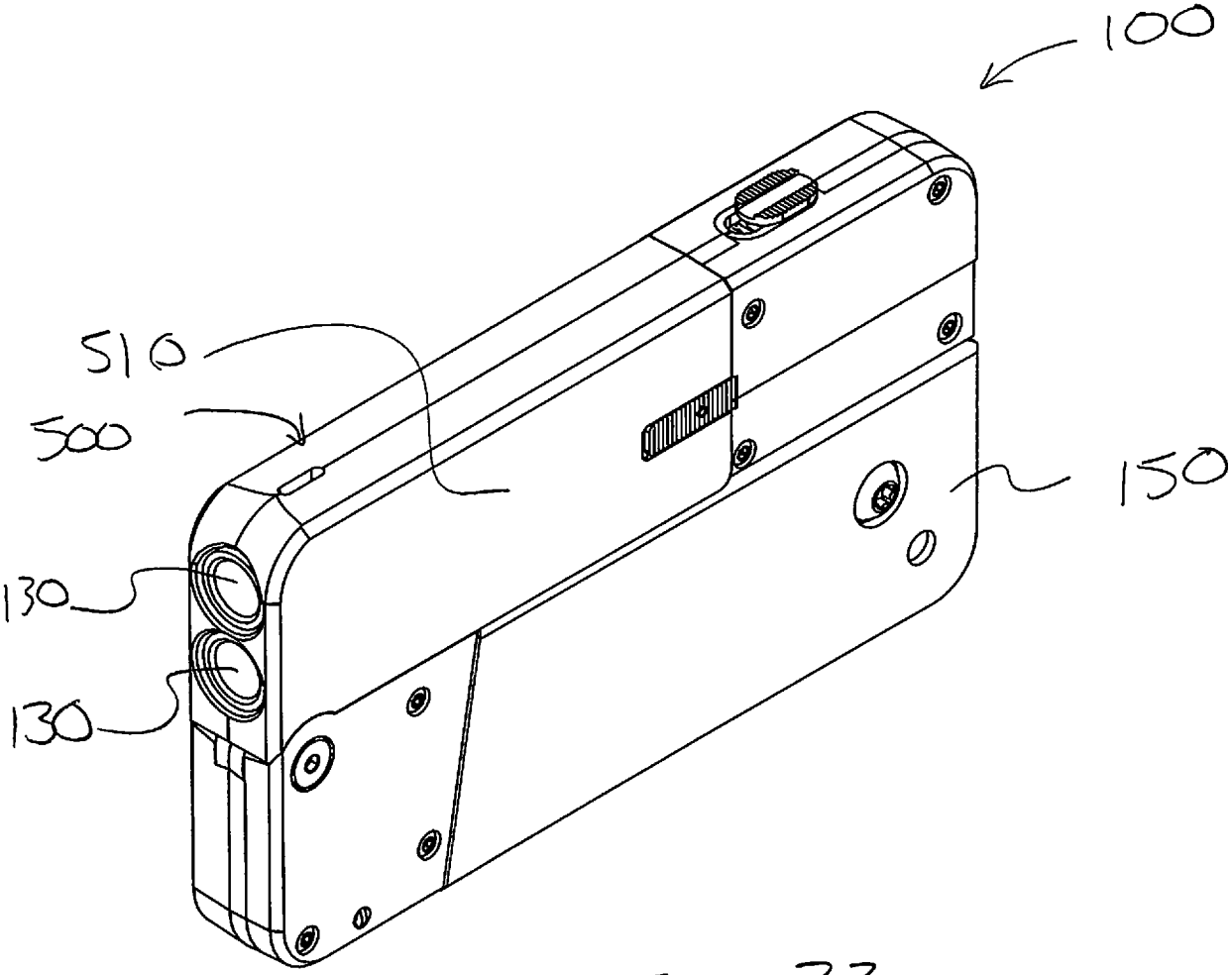
FIG. 33 is a front right perspective of a concealable firearm according to a third embodiment of the invention in its stored configuration.
Figure 35:
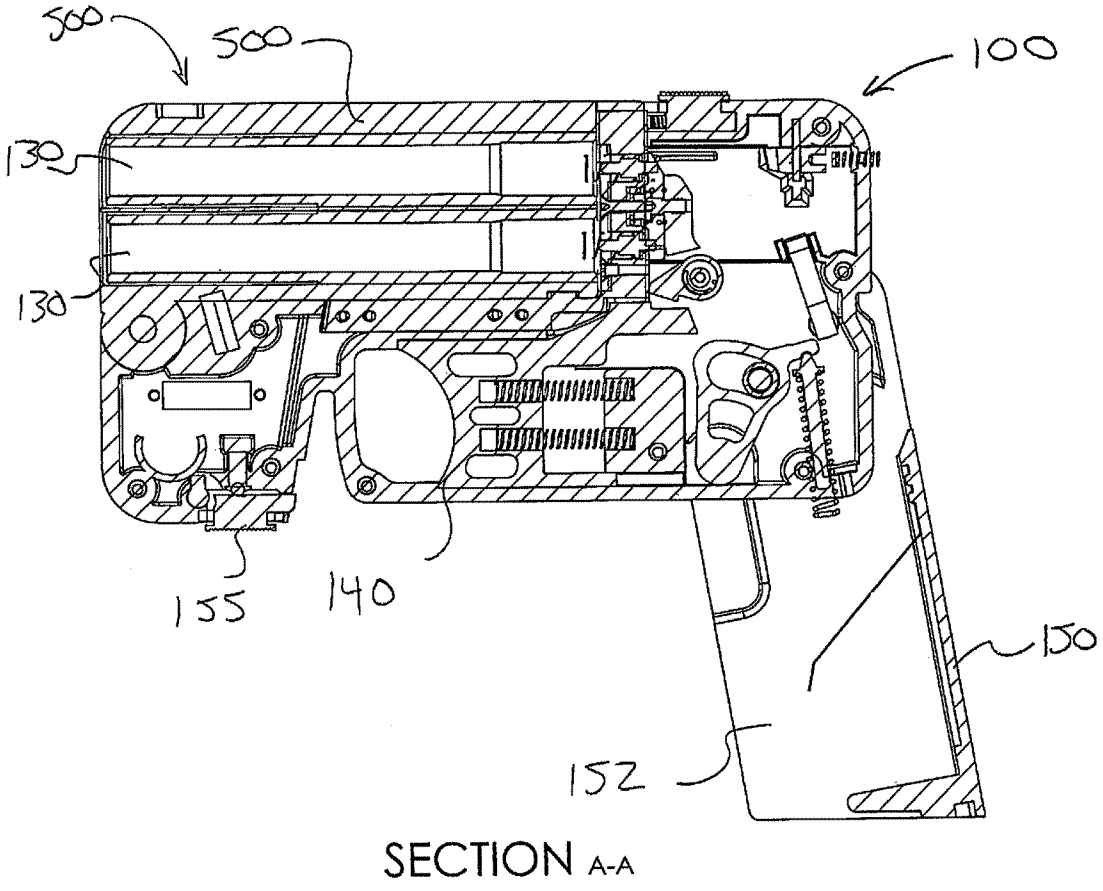
FIG. 35 is a sectional view of a concealable firearm according to a third embodiment of the invention in its in-use configuration.
Figure 34:
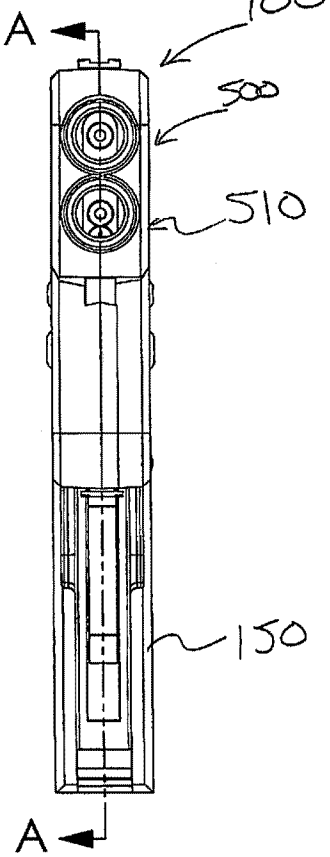
FIG. 34 is a front elevation view of a concealable firearm according to a third embodiment of the invention in its in-use configuration.
Figure 36:
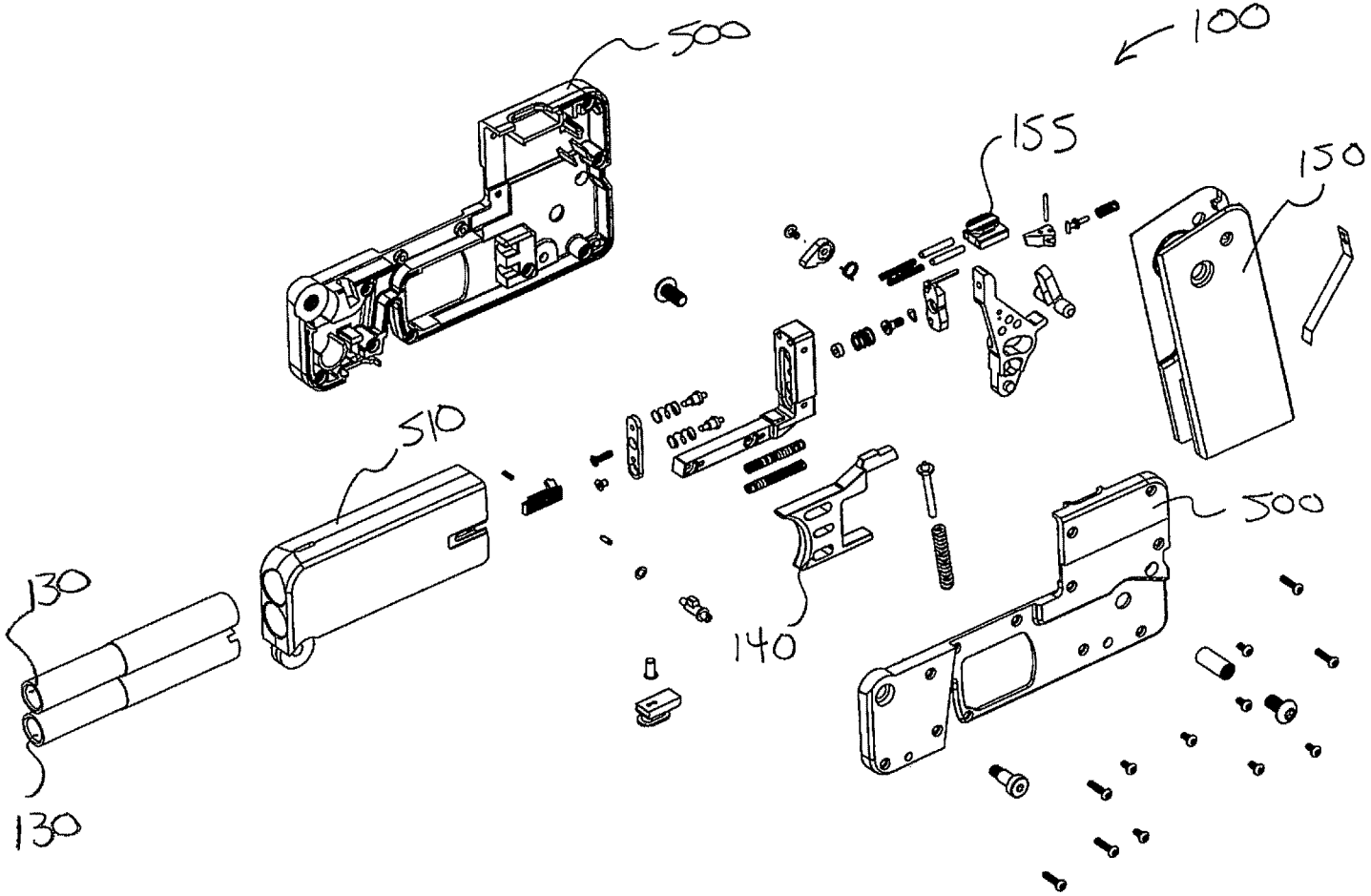
FIG. 36 is an exploded view of a concealable firearm according to a third embodiment of the invention.

FIG. 15 presents cross-section along line A-A of FIG. 9, showing the internal components of an embodiment of concealable firearm 100. Concealable firearm 100 includes at least one trigger spring 290 to return trigger 140 to its ready-to-fire position after being pulled. In this embodiment, trigger 140 pulls down sear pin 270, releasing the firing pin 230. Release of the firing pin 230 causes firing pin spring 210 to force firing pin 230 to slide forward inside the firing pin guide 220 (shown in FIG. 16) and strike the bullet (not shown) within the barrel 130. Release of trigger 140 allows sear pin 270 to be pushed back up to its initial position by sear spring 280. Firing pin 200 is returned to its cocked position by firing pin rebound spring 230.

Bullets (not shown) are stored in the tubular magazine 160. In the embodiment shown in FIGS. 15-16, the capacity of the tubular magazine 160 is three bullets. Bullets are fed from the tubular magazine 160 by a tubular magazine spring 165 to the barrel 130 via a breach lock tipping block 310 and lifter 250. Feed stop 300 ensures that only a single bullet is lifted into the barrel 130. Barrel 130 includes chamber 135 for securing bullet in place prior to firing. The slide 120 strips the bullet off the lifter 250 and seats it into the chamber 135 to be fired. After the bullet is fired the explosive force pushes the slide 120 back and an extractor 240 pulls the spent casing back until it hits an ejector 320 to expel the spent casing from the concealable firearm 100.

An aspect of the invention that allows the concealable firearm 100 to convert from its in-use configuration to its stored configuration is the grip cavity 152. Grip cavity 152 is sized and configured to accept the portion of the receiver body 110 that comprises the trigger 140. When in the stored position, trigger 140 is covered by grip 150. This provides protection against inadvertent discharge of the concealable firearm 100 because the trigger 140 is not accessible. It also allows the concealable firearm 100 to have the proper shape to mimic a cell phone or cell phone case. The grip 150 may also include a grip stop 158 that is configured to nest within a stop notch 115 of the receiver body 110 when the concealed firearm 100 is in its stored configuration. The grip 150 may include a grip shoulder 157 configured to butt against a notch in the receiver body 110 to provide additional stability to concealable firearm 100 while in the in-use configuration.

FIGS. 17-31 present an alternate embodiment for the concealable firearm 100 of the invention. Instead of a tubular magazine 160 (shown in FIGS. 1-16), this embodiment utilizes a conventional magazine 400 for storage and lateral feeding of bullets into the chamber 135. In this embodiment, bullets are stored in conventional magazine 400 and are raised to the chamber 135 via a magazine spring 410 instead of a lifter 250 (shown in FIGS. 1-16). Conventional magazine 400 is loaded into a magazine well 405 formed in the receiver body 110. A magazine catch 420 locks the conventional magazine 400 into the receiver body 110 and can be pressed to release the conventional magazine 400. A magazine catch spring 430 keeps the magazine catch 420 in locked position.

The materials of construction for the various components of the concealable firearm 100 are preferably as light as possible and highly formable while being strong enough for the components intended use and durable for repeated use. The receiver body 110, slide 120, and grip 150 are preferably constructed of glass-filled nylon to allow the exterior of the concealable firearm 100 to be formed in the shape of a cell phone and being light-weight, but strong enough to function as a firearm. These components may also be constructed of aluminum, carbon fiber, or stainless steel. The barrel 130 is preferably constructed of 4140 chromoly steel for durability, but can also be made from stainless steel. The tubular magazine spring 165, firing pin spring 220, firing pin rebound spring 230, rebound spring 260, sear spring 280, trigger spring(s) 290, magazine spring 410, and magazine catch spring 430 are preferably constructed of music wire, but may also be constructed of stainless steel spring wire. Due to the severe service conditions, hardened carbon steel is the preferred material for the firing pin 200, but can also be made of lighter high-strength material such as titanium. The firing pin guide 220 is preferably made of polyoxymethylene (brand name Delrin® made by Dupont) for its high strength, hardness and rigidity. The preferred material for the other components of the concealable firearm 100 is coated carbon steel, but stainless steel may also be used. The preferred material for the conventional magazine 400 is polyether ether ketone (PEEK) for its robustness and light weight, but other materials such as polyetherimide (brand name Ultem™ made by Saudi Basic Industries Corporation), carbon filled nylon, and steel are acceptable alternatives. While the above materials of construction are preferred for the present invention, those of skill in the art will be aware of other materials that may be substituted due to performance, durability, cost, and aesthetic considerations.

FIGS. 32-36 present a third embodiment for the concealable firearm 100 of the invention. This embodiment contemplates the concealed firearm as being a Derringer-type pistol (i.e., one without a magazine). The concealable firearm 100 may be one or more barrels, but is depicted in FIGS. 32-35 as a two-barrel concealable firearm 100. For this embodiment, the barrel housing 510 pivots forward with respect to the body 500 (shown in FIG. 36 constructed of two halves) to allow loading of bullets (not shown) into each barrel 130. The mechanics of the concealable firearm 100 of this embodiment are those typical of Derringer-type pistols known in the art.

The materials of construction for the various components of the concealable firearm 100 are preferably as light as possible and highly formable while being strong enough for the components intended use and durable for repeated use. The receiver body 110, slide 120, and grip 150 are preferably constructed of glass-filled nylon to allow the exterior of the concealable firearm 100 to be formed in the shape of a cell phone and being light-weight, but strong enough to function as a firearm. These components may also be constructed of aluminum, carbon fiber, or stainless steel. The barrel 130 is preferably constructed of 4140 chromoly steel for durability, but can also be made from stainless steel. The tubular magazine spring 165, firing pin spring 220, firing pin rebound spring 230, rebound spring 260, sear spring 280, trigger spring(s) 290, magazine spring 410, and magazine catch spring 430 are preferably constructed of music wire, but may also be constructed of stainless steel spring wire. Due to the severe service conditions, hardened carbon steel is the preferred material for the firing pin 200, but can also be made of lighter high-strength material such as titanium. The firing pin guide 220 is preferably made of polyoxymethylene (brand name Delrin® made by Dupont) for its high strength, hardness and rigidity. The preferred material for the other components of the concealable firearm 100 is coated carbon steel, but stainless steel may also be used. The preferred material for the conventional magazine 400 is polyether ether ketone (PEEK) for its robustness and light weight, but other materials such as polyetherimide (brand name Ultem™ made by Saudi Basic Industries Corporation), carbon filled nylon, and steel are acceptable alternatives. While the above materials of construction are preferred for the present invention, those of skill in the art will be aware of other materials that may be substituted due to performance, durability, cost, and aesthetic considerations.

I claim:

1. A concealable firearm comprising:

a receiver body;

a slide;

a trigger; and a grip adjustable between a stored position and an in-use position, the grip comprising a grip cavity sized and configured to receive and cover at least a portion of the trigger in the stored position such that the trigger is not accessible in the stored position;

wherein when the grip is in the stored position, the receiver body, slide, and grip form a structure having edges that generally define a rectangular prism.

2. The concealable firearm of claim 1, further comprising a grip pivot about which the grip pivots between the stored position and the in-use position.

3. The concealable firearm of claim 2, further comprising a grip latch that can be toggled between a locked position and an unlocked position, wherein in the locked position, the grip latch locks the grip in the stored position.

4. The concealable firearm of claim 2, further comprising a tubular magazine for longitudinal loading of bullets to a lifter that loads the bullets into a chamber of the slide.

5. The concealable firearm of claim4, wherein the tubular magazine has a capacity of at least three bullets.

6. The concealable firearm of claim 2, further comprising a magazine positioned rearward of the trigger and comprising a spring for loading bullets into a chamber of the slide.

7. The concealable firearm of claim 2, wherein the grip further comprises a grip shoulder, limiting pivot of the grip toward the in-use position, and a grip stop, limiting pivot of the grip toward the stored position.

8. The concealable firearm of claim 7, wherein the receiver body comprises a stop notch configured for receiving the grip stop.

9. The concealable firearm of claim 2, wherein when the grip is in the stored position, the concealable firearm has a height of less than 3.25 inches, a length of less than 5.75 inches, and a thickness of less than 1 inch.

10. A firearm comprising:

a receiver body;

a slide;

a trigger; and a grip that is pivotable between a stored position and an in-use position;

wherein when the grip is in the stored position, the receiver body, slide, and grip form a structure having edges that generally define a rectangular prism.

11. The firearm of claim 10, wherein the trigger is not accessible when the grip is in the stored position.

12. A handgun comprising:

a receiver body;

a barrel housing, housing at least one barrel;

a trigger; and a grip adjustable between a stored position and an in-use position;

wherein when the grip is in the stored position, the receiver body, barrel housing, and grip form a structure having edges that generally define a rectangular prism; and wherein the barrel housing pivots with respect to the receiver body permitting loading of a bullet into each of the at least one barrel.

13. The handgun of claim 12, further comprising a grip latch that can be toggled between a locked position and an unlocked position, wherein in the locked position, the grip latch locks the grip in the stored position.

14. The concealable firearm of claim 1, wherein when the grip is in the stored position, the receiver body, slide, and grip form a structure having edges that generally define a rectangular prism with rounded corners.

15. The concealable firearm of claim 14, wherein when the grip is in the stored position, the receiver body, slide, and grip form a structure having edges that generally define a rectangular prism with chamfered edges.

16. The firearm of claim 10, further comprising a tubular magazine for longitudinal loading of bullets to a lifter that loads the bullets into a chamber of the slide.

17. The firearm of claim 10, further comprising a magazine positioned rearward of the trigger and comprising a spring for loading bullets into a chamber of the slide.

18. The firearm of claim 10, wherein when the grip is in the stored position, the receiver body, slide, and grip form a structure having edges that generally define a rectangular prism with rounded corners.

19. The handgun of claim 12, wherein when the grip is in the stored position, the receiver body, barrel housing, and grip form a structure having edges that generally define a rectangular prism with rounded corners.

20. The handgun of claim 19, wherein when the grip is in the stored position, the receiver body, barrel housing, and grip form a structure having edges that generally define a rectangular prism with chamfered edges.

21. The handgun of claim 12, wherein the grip comprises a grip cavity sized and configured to receive and cover at least a portion of the trigger in the stored position such that the trigger is not accessible in the stored position.

* * * * *